US009488319B2

(12) United States Patent
Jin

(10) Patent No.: US 9,488,319 B2
(45) Date of Patent: Nov. 8, 2016

(54) FILM CHEMILUMINESCENT DEVICE

(76) Inventor: Zhaoyang Jin, Beijing (CN)

( * ) Notice: Subject to any disclaimer, the term of this patent is extended or adjusted under 35 U.S.C. 154(b) by 126 days.

(21) Appl. No.: 14/118,164

(22) PCT Filed: May 16, 2012

(86) PCT No.: PCT/CN2012/000676

§ 371 (c)(1),
(2), (4) Date: Nov. 15, 2013

(87) PCT Pub. No.: WO2012/155537

PCT Pub. Date: Nov. 22, 2012

(65) Prior Publication Data

US 2014/0092579 A1 Apr. 3, 2014

(30) Foreign Application Priority Data

| | | |
|---|---|---|
| May 17, 2011 | (CN) | 2011 1 0127545 |
| Jan. 31, 2012 | (CN) | 2012 1 0021367 |
| Jan. 31, 2012 | (CN) | 2012 2 0030618 |
| Feb. 27, 2012 | (CN) | 2012 1 0048048 |
| Feb. 27, 2012 | (CN) | 2012 2 0069017 |
| Apr. 19, 2012 | (CN) | 2012 1 0116289 |

(51) Int. Cl.
*F21K 2/06* (2006.01)

(52) U.S. Cl.
CPC ..... *F21K 2/06* (2013.01)

(58) Field of Classification Search
CPC ..... F21K 2/00; F21K 2/06
USPC ..... 362/34
See application file for complete search history.

(56) References Cited

U.S. PATENT DOCUMENTS

| | | | | |
|---|---|---|---|---|
| 3,749,679 | A | 7/1973 | Rauhut | |
| 3,911,038 | A | 10/1975 | Maulding | |
| 4,508,642 | A | 4/1985 | World | |
| RE35,132 | E * | 12/1995 | Bay | F21K 2/06 206/219 |
| 6,126,871 | A | 10/2000 | Cranor | |
| 7,234,827 | B2 | 6/2007 | Fujita | |

FOREIGN PATENT DOCUMENTS

| | | | |
|---|---|---|---|
| CN | 1427933 | A | 7/2003 |
| CN | 101173735 | A | 5/2008 |
| CN | 201198960 | Y | 2/2009 |

(Continued)

OTHER PUBLICATIONS

State Intellectual Property Office of China, International Search Report of PCT/CN2012/000676, Aug. 23, 2012, WIPO, 8 pages.

*Primary Examiner* — Anabel Ton
(74) *Attorney, Agent, or Firm* — Alleman Hall McCoy Russell & Tuttle LLP

(57) ABSTRACT

A chemiluminescent device comprising a luminous body with a cavity enclosed by a transparent or semitransparent film casing is described. Part of a luminous body is sheathed in a waterproof bag and separated from part of the luminous body out of the waterproof bag by a separating and sealing device from the exterior. Two or more sealed storage cavities are formed, and each waterproof bag is also sealed as a waterproof protective cavity. The corresponding storage cavities contain radiant agents and oxidizing agents in different storage cavities. In addition, radiant agents and/or oxidizing agents are respectively sealed in breakable storage bags provided with an aluminum foil wrap layer composed of one or more layers of aluminum foil. Furthermore, a chemiluminescent device with an image device can be provided, wherein the image device is arranged in the luminous body.

19 Claims, 17 Drawing Sheets

(56) References Cited

FOREIGN PATENT DOCUMENTS

| | | | |
|---|---|---|---|
| CN | 201507790 | U | 6/2010 |
| CN | 202149366 | U | 2/2012 |
| JP | 2003005678 | A | 1/2003 |
| JP | 2004265809 | A | 9/2004 |

* cited by examiner

FILM CHEMILUMINESCENT DEVICE

CROSS-REFERENCE TO RELATED APPLICATIONS

This is the U.S. National Phase of International PCT Application Serial No. PCT/CN2012/000676 filed on May 16, 2012, which claims priority to Chinese Patent Application Numbers CN201110127545.5 filed on May 17, 2011, CN201210021367.2 filed on Jan. 31, 2012, CN201220030618.9 filed on Jan. 31, 2012. CN201210048048.0 filed on Feb. 27, 2012, CN201220069017.9 filed on Feb. 27, 2012, and CN201210116289.4 filed on Apr. 19, 2012, all of which are hereby incorporated by reference in their entirety for all purposes.

FIELD OF TECHNOLOGY

A chemiluminescent device made from a thin film is involved in this invention.

BACKGROUND TECHNOLOGY

The chemiluminescent device with a thin film as its shell has been structurally designed since people started to use chemiluminescent technology. Its shape could be easily changed or endowed with patterns, however, there is scarcely any practical products produced or applied through the ages. In the following, we will expound & analyze this phenomenon from the fundamental principle of chemiluminescence.

Generally, chemiluminescence for civil use is generated from the chemical reaction by mixing chemiluminescent chemicals, such as substituted-phenyl bis oxalate, fluorescent, oxidizer, activator, solvent etc. The ingredients that contain substituted-phenyl bis oxalate (bis oxalate for short) are called luminescent agents or ingredients that contain bis oxalate, while the ingredients that contain peroxide such as oxidizer are known as oxidizer or activating agent. Usually, the peroxide used is hydrogen peroxide or carbamide peroxide. Generally speaking, the fluorescent agent is in the ingredients, which contain bis oxalate, and the activator is in the one that contains peroxide such as oxidizer. However, this is not absolute. It is feasible that fluorescent agent is in ingredients which contain oxidizer, while activator is in the one that contains bis oxalate. The same situation can be applied to the using of solvent. The ingredients that contain oxidizer or bis oxalate could be dissolved in solvent; also the solvent could be used in only one of them. Under different environments, the glowing effect of ingredients with high viscosity or a solid could be achieved by using different solvents or dispersants, even without using solvents. Chemiluminescence can be obtained by mixing the above-mentioned ingredients that respectively contain luminescent agent or oxidizer. In the field of chemiluminescence, any one or the compound of chemicals got involved, such as bis oxalate, peroxide, fluorescent agent, activator and solvents etc. are collectively called chemiluminescent chemicals. Under normal conditions, the most widely used substituted-phenyl bis oxalate refers to Bis (2, 4, 5-trichloro amyl salicylate) oxalate (CPPO) or Bis (2, 4, 5-trichloro isoamyl salicylate) oxalate (CIPO). Detailed exposition on the technology in this respect had been in U.S. Pat. Nos. 3,749,679, 3,911,038, 4,508,642 and 6,126,871.

As bis oxalate tends to be hydrolyzed, generally the ingredients that contain bis oxalate are required to be isolated from the moisture in the air. The moisture has a strong impact on glowing effect, and could even lead to product failure. So in chemiluminescent devices, ingredients that contain bis oxalate are usually sealed in ampoule made from glass. When using the device, the ampoule is broken to mix them with ingredients which contain oxidizer, and then glowing could be achieved. The usage of glass restricts development of many products, especially the ones with thin shell. Piercing and security problems of the broken glass have hampered development of product forms.

In China patent CN1427933A, it expounds a technology for storing bis oxalate by using composite of aluminum foil compounded with macromolecular materials. In this technology, Polyethylene or Polypropylene coating is overlaid or deposited on the surface of aluminum foil, and then the foil is made into bags by welding. However, polyolefin coating is so thin to get mechanical bearing strength. While the aluminum foil itself almost has no mechanical strength. These factors determine that the capacity of the sealing bag, in which oxalate solution is stored, can not be too big. Usually, it is about 1-2 ml. When it is more than 2 ml, the bag is easy to damage & leak during storage and transport. At the same time, this kind of composite material made from aluminum foil and polymer is frail in production. It is easy to crack and damage. Moreover, it is not suitable to use the bag made from aluminum foil with the polyolefin coating on its surface to store oxidizer solution, as the coating could be detached from aluminum foil under the action of peroxide.

Even if we do not consider existing techniques on storage period, there are also some problems that need improving for the chemiluminescent device made from thin film, such as: the liquid inside existing chemiluminescent component that is made from thin film, is prone to flow to lower part when the device is used not laid flat, thus affecting the use effect. At the same time, as thin film is soft, it can not be endowed with shapes required easily. In addition, when the existing chemiluminescent products are used as light source for displaying the patterns, typical applications are in this way—the patterns are printed or stuck outside the device. The patterns could be shown via the light glowing from inside of the chemiluminescent device. A similar method is described in China Patent 201507790U, wherein a chemiluminescent device is placed in a hollow printed packaging bag. The common features of this kind of glowing device are: the glowing with a silhouette effect, and the contour feature of the pattern is clear. However, the effect of color rendition and contrast levels for these patterns is bad. For example, as light is emitted from inside of the device, the levels and colors of pattern outside the device can not be discerned in total darkness.

DISCLOSURE OF INVENTION

The objective of this invention is to provide a kind of chemiluminescent device made from thin film.

DIVISION SEALING DEVICE

The chemiluminescent device provided in this invention contains illuminant (1), i.e., the cavity enclosed by transparent or translucent thin film. In this device, one or more impermeable bags (5) that are placed over a part of said illuminant (1). Division sealing device (2) is set at the opening of each impermeable bag (5). Part of illuminant (1) inside impermeable bag (5) is separated from the part outside by division sealing device (2), and two or more chemical storage cavities (3) are formed. At the same time, impermeable cavity (8) is obtained via sealing each impermeable bag (5) by division sealing device (2). Chemical storage cavities (3) are sealed in corresponding impermeable cavities (8). Luminescent agent (9) & oxidizer (10) are respectively sealed in different chemical storage cavities (3).

The described chemiluminescent device contains illuminant (1), i.e. the cavity enclosed by transparent or translucent thin film. In this device, impermeable bag (5) is set outside illuminant (1). Illuminant (1) is placed into impermeable bag (5) and sealed to be separated from outer environments. One or more division sealing devices (2) can be set outside impermeable bag (5). Illuminant (1) is separated and sealed into two or more chemical storage cavities (3) from the outside of impermeable bag (5) by division sealing device (2). Meantime, division sealing device (2) separates impermeable bag (5) into two or more impermeable cavities (8). Two or more chemical storage cavities (3) are respectively separated and sealed in the corresponding impermeable cavities (8). Luminescent agent (9) & oxidizer (10) are sealed in different chemical storage cavities (3).

The described illuminant (1), which is made from thin film, is a transparent cavity with continuous shell made from macromolecular material. And part of it is combined with aluminum foil (17) to form impermeable bag (5). Luminescent agent (9) is stored in the impermeable bag (5). Oxidizer (10) is stored in area (18), which is not combined with aluminum foil (17). Removable division sealing device (2) is set between impermeable bag (5) & area (18) to separate the two kinds of chemicals. The described removable division sealing device (2) is set outside impermeable bag (5) or inside the transparent cavity.

The described illuminant (1), which is made from thin film, is a transparent cavity with continuous shell made from macromolecular material. Part of it is wrapped by impermeable bag (5), which is made with aluminum foil and where the inner surface is combined with macromolecular material. Connective sealing structure (13) is set between the inner surface of impermeable bag (5) and external surface of illuminant (1). Luminescent agent (9) is placed within the area in illuminant (1) that is wrapped by impermeable bag (5), while oxidizer (10) is placed within the area in illuminant (1), which is not wrapped by impermeable bag (5). A removable division sealing device (2) is set between the two areas to separate the two kinds of chemicals. The described removable division sealing device (2) is set outside impermeable bag (5) or inside the illuminant (1).

The described illuminant (1), which is made of thin film, is a transparent cavity with an opening made from macromolecular material. The impermeable bag (5) is a cavity with an opening, made from aluminum foil that the inner surface is combined with macromolecular material. The two cavities are linked together via the opening. Luminescent agent (9) is placed within the area in impermeable bag (5), while oxidizer (10) is placed within the area in illuminant (1), where there is no impermeable bag (5). A removable division sealing device (2) is set between the two areas to separate the two kinds of chemicals. The described removable division sealing device (2) is set outside impermeable bag (5) or inside the illuminant (1).

The described luminescent agent (9) or/and oxidizer (10) are respectively sealed in breakable chemical storage bag (4) with one layer or more. The described breakable chemical storage bag (4) is transparent, translucent or opaque.

A kind of chemiluminescent device is provided in this invention. It contains illuminant (1), i.e. the cavity enclosed by transparent or translucent thin film. In this device, luminescent agent (9) & oxidizer (10) are respectively placed in the described illuminant (1). The described luminescent agent (9) or/and oxidizer (10) are respectively sealed in breakable chemical storage bag (4) with one layer or more. Aluminum foil layer (19), which is made of one or more than one layer of aluminum foil, is set outside the described breakable chemical storage bag (4).

In the described chemiluminescent device, aluminum foil layer (19), which is made of one or more than one layer of aluminum foil, is formed by one or more than one piece of aluminum foil. The edge of aluminum foil exposed to the outside world, is folded one or more times, together with other parts that contact with the edge.

Aluminum foil layer (19), which is made of one or more than one layer of aluminum foil, is set outside the described breakable chemical storage bag (4). The whole or part of aluminum foil layer (19) could be soaked in solidifiable liquid sealing materials, so as to obtain the sealing layer on the outer surface of Part 19. Part of Aluminum foil layer (19) is soaked in solidifiable liquid sealing materials, i.e. the folding area of Part 19 is soaked in sealing materials, so that gaps between the folds can be sealed by the sealing materials.

In the above-described chemiluminescent device, the described sealing materials are solidifiable liquid macromolecule resin, wax, or caking agent. The solidified states of them are breakable.

The outside of described Aluminum foil layer (19) is wrapped by nonocclusive thin film made from macromolecule polymer.

In the two chemiluminescent devices above-mentioned in this invention, the color can be same or different among luminescent agents (9), oxidizers (10) or between part 9 and part 10 in described illuminant (1).

Image showing device (16) could be set in the described illuminant (1).

The materials used to make described image showing device (16) could be chosen from at least one of or composite of the following: paper, macromolecular thin film, non-woven fabrics and fiber. The patterns can be obtained via printing, dyeing, enchasing, folding, watermarking, collage, knitting, spinning or embroidering. It is paper with patterns printed on its surface and macromolecular thin film in this device.

In this device, the material of described macromolecular thin film is chosen from at least one of or composite of the following: PP, PE, PVC, nylon, PET. There is at least one layer for the described image showing device (16). The described fiber material could be at least one of the inorganic and organic materials, among which the inorganic one is glass fiber in this device, while the organic material is chosen from cotton fiber and/or fiber made from macromolecular polymer.

When the material of image showing device (16) is a composite of described paper and macromolecular thin film, the pattern is printed on the surface of the described composite or the inner surface of the composite interlayer.

A kind of chemiluminescent device with image showing device is provided in this invention. It contains illuminant (1), i.e. the cavity enclosed by transparent or translucent thin film. Luminescent agent (9) & oxidizer (10) are placed in the described illuminant (1). Image showing device (16) is set in described illuminant (1).

In the above-described chemiluminescent device, in described illuminant (1), luminescent agent (9) or/and oxidizer (10) are respectively sealed in a breakable chemical storage bag (4) with one layer or more. There could be one or several breakable chemical storage bags (4) in this device.

The described breakable chemical storage bags (4) could be transparent, translucent or opaque.

The color can be the same or different among described luminescent agents (9), oxidizers (10) or between part 9 and part 10.

The materials used to make described image showing device (16) could be chosen from at least one of or composite of the following: paper, macromolecular thin film, non-woven fabrics, fiber. The patterns can be obtained via printing, dyeing, enchasing, folding, watermarking, collage, knitting, spinning, or embroidering. It is paper with patterns printed on its surface and macromolecular thin film in this device.

In this device, the material of described macromolecular thin film is chosen from at least one of or composite of the following: PP, PE, PVC, nylon, PET. There is at least one layer for the described image showing device (16). The described fiber material could be at least one of the inorganic and organic materials, among which the inorganic one is glass fiber in this device, while the organic material is chosen from cotton fiber and/or fiber made from macromolecular polymer.

When the material of image showing device (16) is a composite of paper and macromolecular thin film, the pattern is printed on the surface of the described composite or the inner surface of the composite interlayer.

The image showing device (16) made from paper and macromolecular thin film with patterns printed on the surface is placed within an area in the interior of described illuminant (1). When breakable chemical storage bag (4), in which luminescent agent (9) is sealed, is made from transparent macromolecular thin film, it is placed within the area near one edge of the described illuminant (1). The surface outside this area is wrapped by impermeable bag (5) with an opening at one end, which is made from a composite of macromolecular materials with aluminum foil. The openings of impermeable bag (5) and the outer surface of described illuminant (1) are pressed tightly from the outside of Part 5 via removable division sealing device (2). Then the breakable chemical storage bag (4) that contained luminescent agent (9) in impermeable bag (5) is sealed. The described breakable chemical storage bag (4) that contains oxidizers (10) is placed within the area outside Part 5.

Or, image showing device (16) made up of macromolecular thin film or paper printed with image, is placed at some part of the area in the interior of described illuminant (1). In the remaining area, where it nears at least one edge of illuminant (1), there is a breakable chemical storage bag (4) made of a macromolecular thin film. And luminescent agent (9) is sealed in breakable chemical storage bag (4). The surface outside this area is wrapped by impermeable bag (5) with an opening at one end, which is made from a composite of macromolecular materials with aluminum foil. The openings of impermeable bag (5) and the outer surface of described illuminant (1) are pressed tightly from the outside of Part 5 via removable division sealing device (2). Then the breakable chemical storage bag (4) that contains luminescent agent (9) in impermeable bag (5) is sealed. The described breakable chemical storage bag (4) that contains an oxidizer (10) is placed within the area outside Part 5 or stacked at the area where there is image showing device (16).

Or, image showing device (16) made up of macromolecular thin film or paper printed with image, is placed at some part of the area in the interior of described illuminant (1). In the remaining area, where it nears at least one edge of illuminant (1), there is a breakable chemical storage bag (4) made up of a composite of macromolecular materials with aluminum foil. And luminescent agent (9) is sealed in breakable chemical storage bag (4). The described breakable chemical storage bag (4) made from transparent macromolecular thin film, in which an oxidizer (10) is sealed, is stacked at the area where there is image showing device (16).

Or, image showing device (16) made up of macromolecular thin film or paper printed with image, is placed at some part of the area in the interior of described illuminant (1). In the remaining area, where it nears at least one edge of illuminant (1), there is a breakable chemical storage bag (4) made of macromolecular thin film. And luminescent agent (9) is sealed in breakable chemical storage bag (4). The described breakable chemical storage bag (4) made of a transparent macromolecular thin film, in which an oxidizer (10) is sealed, is stacked at the area where there is image showing device (16). Aluminum foil layer (19) made by one or more than one layer of aluminum foil, is set outside the described breakable chemical storage bag (4) contained with luminescent agent (9).

Or, image showing device (16) made up of macromolecular thin film or paper printed with image, is placed in the interior of described illuminant (1). The described breakable chemical storage bag (4) contained with luminescent agent (9) is sealed, and placed within the area where it nears one edge inside the described illuminant (1). The macromolecular thin film of illuminant (1) in this area can be combined with an aluminum foil impermeable layer to form impermeable bag (5). At the edge of described impermeable bag (5), at the side that the breakable chemical storage bag (4) containing oxidizers (10) is placed, removable division sealing device (2) is set outside or inside the described edge of impermeable bag (5). Then the breakable chemical storage bag (4) that contains luminescent agent (9) is sealed in impermeable bag (5).

The supporting fixture (20) is set in at least one edge of described illuminant (1).

In the three chemiluminescent devices above-mentioned in this invention, when the described illuminant (1) is a bag made by transparent or translucent macromolecular thin film, illuminant (1) is separated into two or more areas by one or more heat-pressing division lines (21). These areas are connected with each other or not. When image showing device (16) is made of paper that printed with image is separated & placed within corresponding areas. When image showing device (16) is made of macromolecular materials or non-woven fabrics, it is heat-pressed with illuminant (1)'s macromolecular film via the heat-pressing division lines (21).

Specifically, the physical form of described chemiluminescent device is a flag or glove.

Specifically, illuminant (1), i.e. the cavity enclosed by thin film shell is vacuumized.

In the three chemiluminescent devices above-mentioned in this invention, the materials of described illuminant (1) & breakable chemical storage bag (4) are chosen from macromolecular resin or at least one of the composites of macromolecular resin and aluminum foil. Among these, the described macromolecular resin materials could be chosen from at least one of or a composite of the following: PP, PE, PVDF, PET, nylon, PVA, high-barrier MA-PVDC, ethylene/EVOH. Among these, the described PET is chosen from at least one of PET and PEN.

The thickness of described breakable chemical storage bag (4) could be 0.0001 mm-0.1 mm, specifically between 0.001 mm and 0.06 mm.

Among these, when the materials of described illuminant (1) are mentioned macromolecular resin, fluoridation treatment can be taken on the surface of illuminant (1) and/or breakable chemical storage bag (4).

The materials of described impermeable bag (5) could be PTFE, a composite of macromolecular material with aluminum foil, PVDF, among which it is a composite of macromolecular material with aluminum foil in specific operation. In the described composite of macromolecular material with aluminum foil, the macromolecular material is chosen from at least one of or a composite of the following: PET, PP and PE.

When the material of described impermeable bag (5) is a composite of macromolecular material with aluminum foil, the thickness of aluminum foil could be 0.003 mm-0.3 mm, specifically between 0.01 mm and 0.2 mm.

The thickness of described impermeable bag (5) is 0.001 mm-0.5 mm, specifically between 0.03 mm and 0.4 mm.

In addition, Absorbent layer (7) could be set in the described illuminant (1).

The material of described absorbent layer (7) can be chosen from at least one of the following: fabric, non-woven fabrics, expanded materials and paper.

Furthermore, chemiluminescent device that is formed by the above-mentioned chemiluminescent devices via multi layers' folding and splicing also falls into protection scope of this invention. Among these, shared plastic film of the surfaces that contact with each other is used in described folding illuminant (1).

A kind of chemiluminescent device that provides an encapsulating space within a barrier made from thin film is provided in this invention. In this device, it includes a shell (27) with at least one contained space (22). Chemiluminescent component (23) is placed within the contained space (22).

The described chemiluminescent component (23) is any above-mentioned chemiluminescent device provided in this invention.

Another kind of chemiluminescent device that provides an encapsulating space within a barrier made from thin film is provided in this invention. In this device, it includes the shell (27) with at least one contained space (22). Chemiluminescent component (23) is set inside contained space (22).

The described chemiluminescent component (23) includes illuminant (1), i.e. the cavity enclosed by transparent or translucent thin film. Luminescent agent (9) & oxidizer (10) are sealed in the described illuminant (1).

Or, the described chemiluminescent component (23) includes illuminant (1), i.e. the cavity enclosed by transparent or translucent thin film. Luminescent agent (9) & oxidizer (10) are sealed in the described illuminant (1). In described illuminant (1), luminescent agent (9) or/and oxidizer (10) are respectively sealed in breakable chemical storage bag (4) with one layer or more. There could be one or several breakable chemical storage bags (4) in this device. The described breakable chemical storage bags (4) could be transparent, translucent or opaque.

In the above-mentioned two kinds of chemiluminescent devices that provide an encapsulating space within a barrier made from thin film, the described shell (27) is a flaky object with a plane or curved surface formed via folding. Or it is formed by fixing several flaky objects or shell-shaped objects with a plane or curved surface via connecting device (24) or friction force. The flaky objects or shell-shaped objects are folded up or set together with each other. The described contained space (22) is formed in the process of folding, stacking or setting.

The described connecting device (24) could be rope, buckle, turnbuckle or fixed by friction force.

The material of shell (27) could be transparent, translucent or opaque. The whole or part of chemiluminescent component (23) is taken into contained space (22). Hollow patterns could be set on the shell (27) or not.

The shape of described shell (27) is cup-shape, mask-shape, plant-shape, animal-shape, or other geometric figures.

Among these, the described other geometric figures can be chosen from at least one of following: circle, square, rectangular, triangle, pentagon, hexagon, polygon, oval. The described cup-shape shell (27) has a double-layer wall of cup. Contained space (22) is formed between the double layers. Chemiluminescent component (23) is set in the contained space (22) so as to form a cup-shaped chemiluminescent device that provides an encapsulating space within a barrier made from thin film. The described mask-shaped shell (27) has a mask shape formed by a continuously varying curved surface. The space between two pieces of this kind of mask is a contained space (22). Chemiluminescent component (23) is set in the contained space (22) so as to form a mask-shaped chemiluminescent device that provides an encapsulating space within a barrier made from thin film.

The shape of described chemiluminescent component (23) and the contained space (22) is the same or similar.

Specifically, the described chemiluminescent component (23) is folded one or several times then placed in contained space (22). Reflecting materials are set in the described contained space (22). Incidental fixing device is set on the described shell (27). The described incidental fixing device could be a hole, clip, double faced adhesive tape, rope, hook or clamp. The described shell (27) is made from materials with shape-memory or this kind of material is set on shell (27).

THE BEST WAY TO IMPLEMENT THIS INVENTION

In the following, we will expound this invention further via combining implementation of the devices specifically. However, this invention is not limited to the following examples. The described methods are conventional ones, if there are no special instructions. The described raw materials can be obtained from publicly commercial channels, if there are no special instructions.

Figure 1:
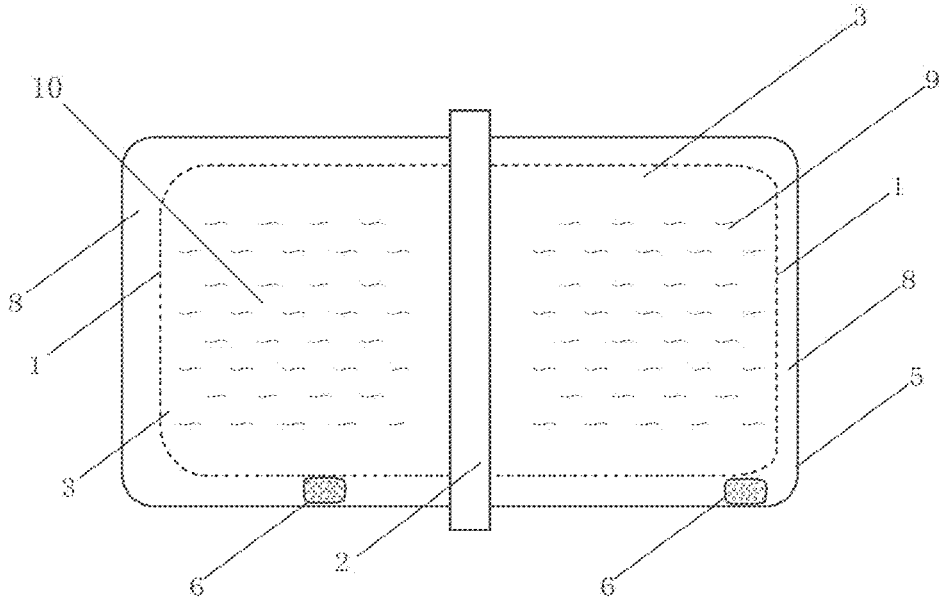
FIG. 1 is a schematic diagram of illuminant totally sealed in the impermeable bag.

As illustrated in FIG. 1, Part 1 is an illuminant, which consists of transparent or semitransparent film. The material of the inner layer is PE (Polyethylene), while the outer layer is PET (Polyethylene terephthalate). Part 5 is an impermeable bag, of which the inner layer is PE, the interface layer is aluminum foil (thickness is 0.01 mm-0.0023 mm), while the outer layer is PET. There is a division sealing device (2) equipped outside the impermeable bag 5. The division sealing device 2 separates Part 1 (illuminant) into two chemical storage cavities (3) from the outside of Part 5 (impermeable bag). Meanwhile, the division sealing device 2 also separates Part 5 into two impermeable cavities (8). The above mentioned chemical storage cavities are separately sealed in the corresponding impermeable cavities (8). Luminescent agents (9) and oxidizer (10) are sealed in different chemical storage cavities (3). When using the product, remove division sealing device 2 from Part 5 (impermeable bag). Luminescent agents (9) and oxidizer (10), which are in Part 1, are mixed with each other, and then gorgeous phenomenon of chemiluminescence spreads out during the process of mixing. The mixing process could be accelerated or adjusted by changing the shape of the film, and without the block by the shading items, the effect of chemiluminescence can be fully shown. The program that external division sealing device 2 is used in conjunction with Part 5 (impermeable bag) has changed the traditional program, which set the impermeable device inside the products, (for example, the piercing problem of the glass tube or light blocking of the aluminum foil bags while set inside), solved the contradiction between the impermeable storage of luminescent agents, which contain oxalate, and the release while using.

In actual production, we could also set multiple division sealing devices 2 outside impermeable bag (5), in addition to setting one division sealing device 2. The division sealing device 2 separates Part 1 (illuminant) into multiple chemical storage cavities (3) from the outside of Part 5 (impermeable bag). Meanwhile, the division sealing device 2 also separates Part 5 into multiple impermeable cavities (8) that correspond to the chemical storage cavities (3).

Also, we can directly make the chemical storage cavity (3) into multiple cavities. In this way, different chemiluminescent chemicals (61) of different colors could be placed in chemical storage cavity (3).

Although, the dye or fluorescent agent is usually added into luminescent agents (9) that contains oxalate, in practice, the dye or fluorescent agent also can be put into oxidizer (10) to make it become the component to determine the chemiluminescnet color. In chemical storage cavity (3) on the left side, it is luminescent agents (9) without fluorescent agent, while when there is two chemical storage cavities (3) on the right side, the two chemical storage cavities (3) contains oxidizer (10) that contains dye or fluorescent agents with different colors. Likewise, division sealing device 2 is removed and the illuminant 1 taken out from Part 5 (impermeable bag) while using the product. Luminescent agents (9) and oxidizer (10) with different colors which are in Part 1, are mixed with each other, and then a gorgeous phenomenon of chemiluminescence spreads out during the process of mixing. At the moment, if the fluorescent agent with the third color is in luminescent agents (9), the phenomenon of chemiluminescence will be more colorful.

Desiccant 6 can be placed in impermeable bag (5) in order to lower the influence of moisture in the air for luminescent agents (9) in the process of transport and storage.

Figure 2:
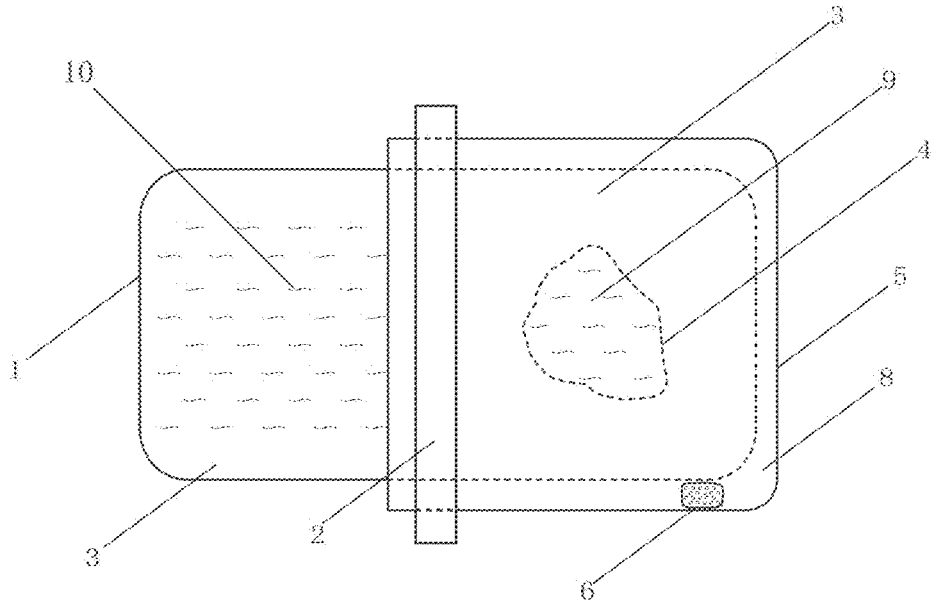
FIG. 2 is a schematic diagram of illuminant, and part of it is sealed in the impermeable bag.

As illustrated in FIG. 2, it is the schematic diagram of illuminant sealed in the impermeable bag and part of the illuminant 1 is sealed in the impermeable bag (5). In the diagram, Part 1 is illuminant. Part 2 is a division sealing device. Part 3 is chemical storage cavity. Part 4 is breakable chemical storage bag. Part 5 is impermeable bag. Part 6 is desiccant. Part 8 is impermeable cavity.

In the practical production, breakable chemical storage bag (4), which contains luminescent agents (9), is placed into the cavity of illuminant (1). Then, desiccant (6) and breakable chemical storage bag (4) that contains luminescent agents (9) are sealed in impermeable bag (5) by means of the division sealing device (2). At the moment, illuminant (1) is separated into two chemical storage cavities (3). Breakable chemical storage bag (4) had been put into one of the chemical storage cavity (3), while the part of illuminant (1) not sealed in impermeable bag (5) turns into the other chemical storage cavity (3)—left part in FIG. 2. We inject oxidizer (10) into this chemical storage cavity (3), and then seal the illuminant (1) completely, after which a device for chemoluminescence is finished by this time.

As moisture in the air affects oxidizer little, in this case, cost for product can be reduced. When using this device, remove Part 2 and impermeable bag (5), then squeeze to break breakable chemical storage bag (4) outside, which contains luminescent agents (9). Luminescent agents (9) and oxidizer (10) are mixed with each other, and then a gorgeous phenomenon of chemiluminescence in the film can be obtained. In this implementation of chemiluminescence, it is feasible that breakable chemical storage bag (4) is not used to pack luminescent agents (9). And it will be more convenient for using in this case.

Two or more breakable chemical storage bags (4) could be placed in chemical storage cavity (3). The color of luminescent agents (9) could be the same or different. When they are the same colors, two breakable chemical storage bags (4) could be used one by one to extend the time of glowing. While luminescent agents (9) are different colors, if they are used one after another, a color changing effect could be achieved. If several breakable chemical storage bags (4) are broken at the same time, a non-uniform glowing effect can be shown.

In order to ensure that luminescent agents (9) sealed in breakable chemical storage bag (4) keeps clear of the moisture in the air, another breakable chemical storage bag could be used outside Part 4, and we could inflate the outer chemical storage bag with adequate amount of inert gases, such as gaseous argon or nitrogen.

The above-mentioned luminescent agents (9) and oxidizer (10) can be sealed in a single layer or multilayer breakable chemical storage bag (4), in order to further improve the performance of encapsulation and separation. Usually, breakable chemical storage bag (4) is transparent or translucent, so as not to affect the glowing effect of this device. However, if it is for functional considerations, such as light avoiding or pattern display, it also could be opaque.

In addition to the above methods, fluoridation treatment can be taken on inner and outer surface of illuminant (1) and breakable chemical storage bag (4) to form a fluoridation layer on the surface. The thickness of fluoride layer is 0.01 um-100 um, among which 0.1 um-10 um is a preferred option. In this way, we can make the fluorine content on the surface of illuminant (1) and breakable chemical storage bag (4) 1 ug/cm$^2$-1000 ug/cm$^2$, among which 50 ug/cm$^2$-300 ug/cm$^2$ is a preferred option to further reduce the invasion & interference of moisture, water, carbon dioxide and acid-base substance for luminescent agents and oxidizer.

In practical production, illuminant (1) could be transparent or translucent macromolecular resin materials, such as FEP, meltable PFA, PP, PE, PA, PVC, PET, PVA, PVDC, MA-PVDC, EVOH, PEN or the composite of their double layers or multi-layers. The thickness is 0.001 mm-2 mm, among which 0.01 mm-0.5 mm is the preferred choice. The inner layer of the composite is PE, while the outer layer is PET. Or the inner is PE, while the outer is PA or the composite of PET, PVDC and PE. They are all effective choices, and have a good effect of chemical resistance, as well as favorable intensity.

The total thickness of impermeable bag (5) is 0.002 mm-0.5 mm. The material is meltable PFA, FEP, a composite of macromolecular material with aluminum foil, PP, PE, PVC, PET, PVA, PVDC, MA-PVDC, EVOH, PEN, or the composite of their double layers or multi-layers, among which a composite of macromolecular materials with aluminum foil are preferred options. The macromolecular material could be one of PET, PP, PE or the composite of these materials.

When impermeable bag (5) is a composite of macromolecular material with aluminum foil, the thickness of aluminum foil is 0.001 mm-0.3 mm, and it is preferable to choose a thickness between 0.01 mm and 0.23 mm.

The material of breakable chemical storage bag (4) is macromolecular resin. The preferred option should be FEP, meltable PFA, PP, PE, PA, PVC, PET, PVA, PVDC, MA-PVDC, EVOH, PEN or the composite of their double layers or multi-layers. The thickness of it is 0.0001 mm-0.1 mm, and it is preferable to choose a thickness between 0.001 mm and 0.06 mm.

The above mentioned materials and their thickness also could be applied to the implementation of the device below.

In the above implementation of the device, the shape of rectangular illuminant can be easily changed into a square, circle, triangle, ring shape, etc. The size could be large enough to table cloth or small to the tray liners, tablemat, etc. In practical production, the shape of a dumbbell, where both ends are wide while the middle part is narrow, could be applied to illuminant (1). The cost can be reduced, while the length of the seal clip could be shortened in such a design. Or there is another way, where the area of chemical storage cavities (3) & impermeable bag is minimize, while making the area for mixing chemicals larger.

Figure 3:
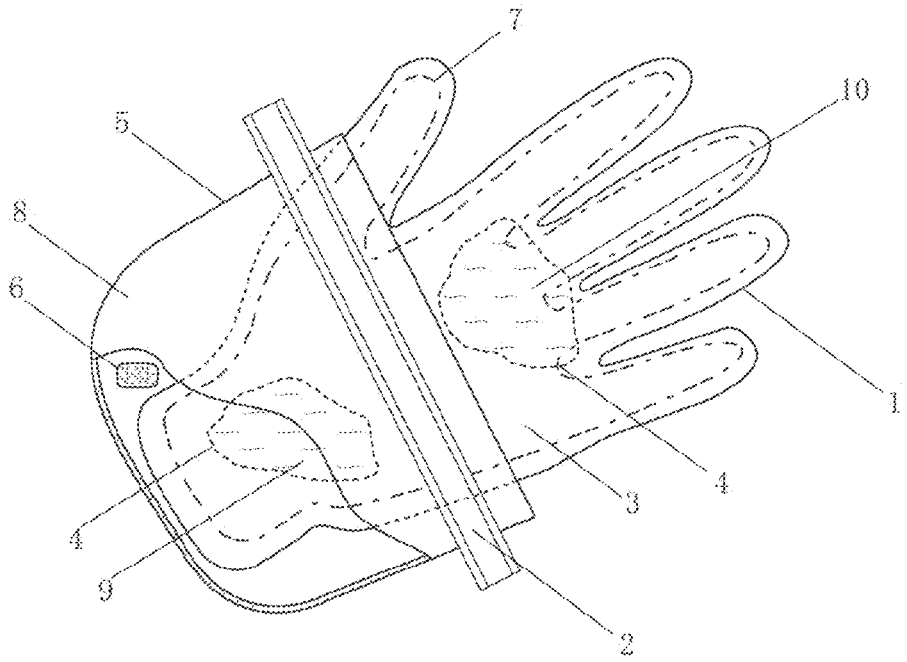
FIG. 3 is a schematic diagram of glove-shaped chemiluminescent device in this invention.

As illustrated in FIG. 3, illuminant (1) is complete gloves, which are set by two gloves. Glove A and Glove B are set together to form illuminant (1) with interlayer. The inner of the interlayer becomes chemical storage cavity (3). Luminescent agents (9) and oxidizer (10) are sealed into breakable chemical storage bag (4) separately, and then the breakable chemical storage bags are put into the chemical storage cavity (3). Chemluminescent gloves can be formed by solder sealing the under-part of the gloves.

Desiccant (6) and breakable chemical storage bag (4), which contains luminescent agents (9) are sealed in the impermeable bag (5) by using division sealing device (2). When using the glowing glove, remove Part 2 and Part 5, then squeeze to break breakable chemical storage bags (4), which contain luminescent agents (9) and oxidizer (10) separately. Luminescence takes place while the two kinds of chemicals mix with each other.

Absorbent layer (7), which can be made of textile, non-woven fabrics, paper, etc. is able to be set in the illuminant (1), in order to get an even glowing effect for the device.

Figure 4:
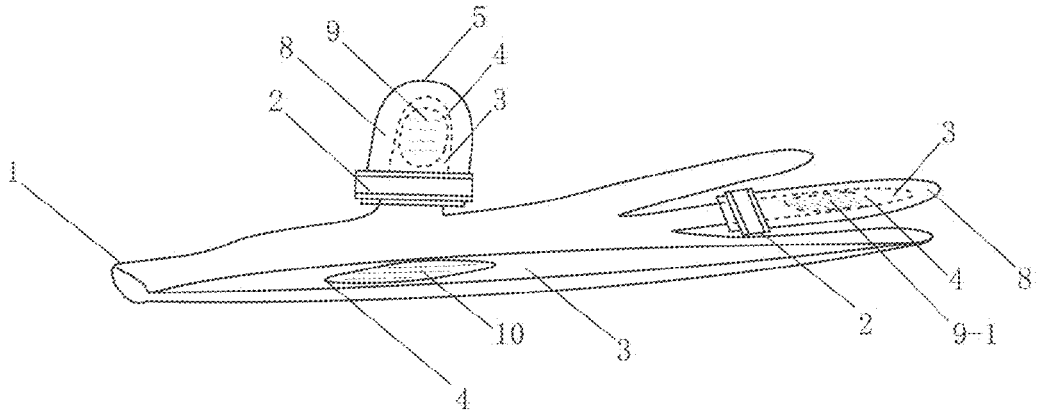
FIG. 4 is a schematic diagram of chemiluminescent glove with several impermeable bags.

As illustrated in FIG. 4, which shows a schematic diagram of the glow glove with several impermeable bags (5). What differs from FIG. 3 is that there are three pieces of plastic film with the hand shape, which form two interlayers by solder sealing the edge of the film. One of the interlayers could be worn, as the wrist part of the glow glove is opened up, while the other interlayer is completely sealed. Several impermeable bags (5) are set in this device, they cover different fingers of the glove-shaped illuminant (1). Breakable chemical storage bag (4) that contain luminescent agents (9) are sealed in the impermeable bags (5), which form the impermeable cavities (8) by using several division sealing devices (2). At this moment, illuminant (1) was separated into three chemical storage cavities (3). Breakable chemical storage bag (4) that contains oxidizer (10) is sealed in the chemical storage cavities (3), where there is no impermeable bag (5).

In this device, two fingers are covered by impermeable bags (5). In practical production, other fingers could be covered by impermeable bag (5) to get more chemical storage cavities (3). Different colors of luminescent agents can be sealed in the corresponding chemical storage cavities (3). When you use the product, remove device 2 and Part 5 (impermeable bag), then squeeze to break the breakable chemical storage bag (4) to make Luminescent agents (9) and oxidizer (10) mix with each other, and then a gorgeous phenomenon of several colors existing at the same time will take place because of the difference during the process of mixing.

If the breakable chemical storage bags (4) are squeezed one after another, a long time of color-changing effect could be achieved. In this implementation, the Luminescent agents (9), which are sealed in the breakable chemical storage bag (4) that is placed in the chemical storage cavities (3), could be the same color.

When using the device, breakable chemical storage bags (4) could be squeezed in each time interval to extend time of glowing. In practical production, for Luminescent agents (9) and oxidizer (10), one of them could be solid or semi-solid, while the other is a fluid. The viscosity of luminescent agents (9) and oxidizer (10) could be adjusted to make a different effect of liquidity, when they are mixed with each other.

Figure 5:
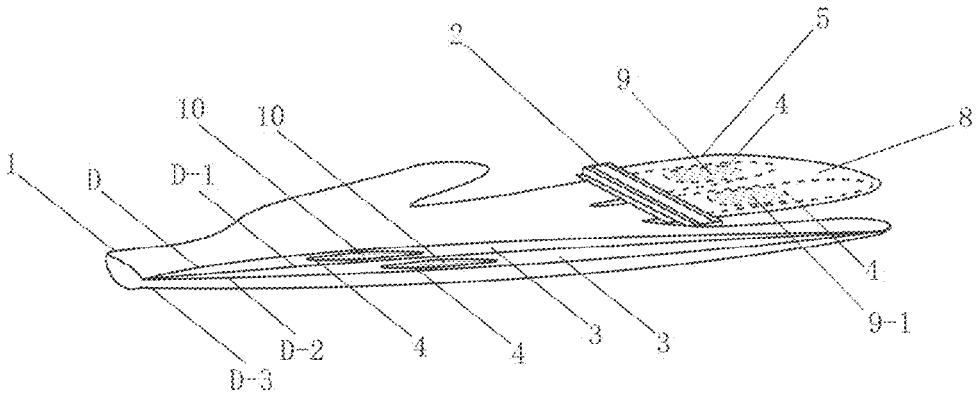
FIG. 5 is a cross-sectional view of chemiluminescent device with several pieces of glove shaped plastic film.

As illustrated in FIG. 5, which shows a cross-sectional view of the chemical glowing device with several pieces of hand shaped plastic film. In this device, illuminant (1) is the one with interlayers consisting of Part D, Part D-1, Part D-2, and Part D-3. Part D and Part D-1 together with Part D-2 respectively form chemical storage cavities (3). At this moment, D-1 is one piece of plastic film shared by illuminants on either side. Breakable chemical storage bag (4) that contains luminescent agents (9) and oxidizer (10) are sealed in the chemical storage cavities (3). Then, the glowing glove is finished by solder sealing D-2 and D-3 with the wrist part open. Breakable chemical storage bag (4) that contain luminescent agents (9) are sealed in impermeable bags (5) by using several devices with function of separation and encapsulation (2). In this implementation, one impermeable bag (5) covers the breakable chemical storage bags (4) that are respectively put in two fingers in two layers. The color of luminescent agents (9) sealed in breakable chemical storage bags (4) can be different. When using it, remove division sealing device (2) and impermeable bag (5), then squeeze to break the breakable chemical storage bag (4) to make Luminescent agents (9) and oxidizer (10) mix with each other, and then a gorgeous phenomenon of glowing will take place. As the color glowing in two interlayers is different and there is a chance for them overlapping, the glowing effect becomes more amazing.

Figure 6:
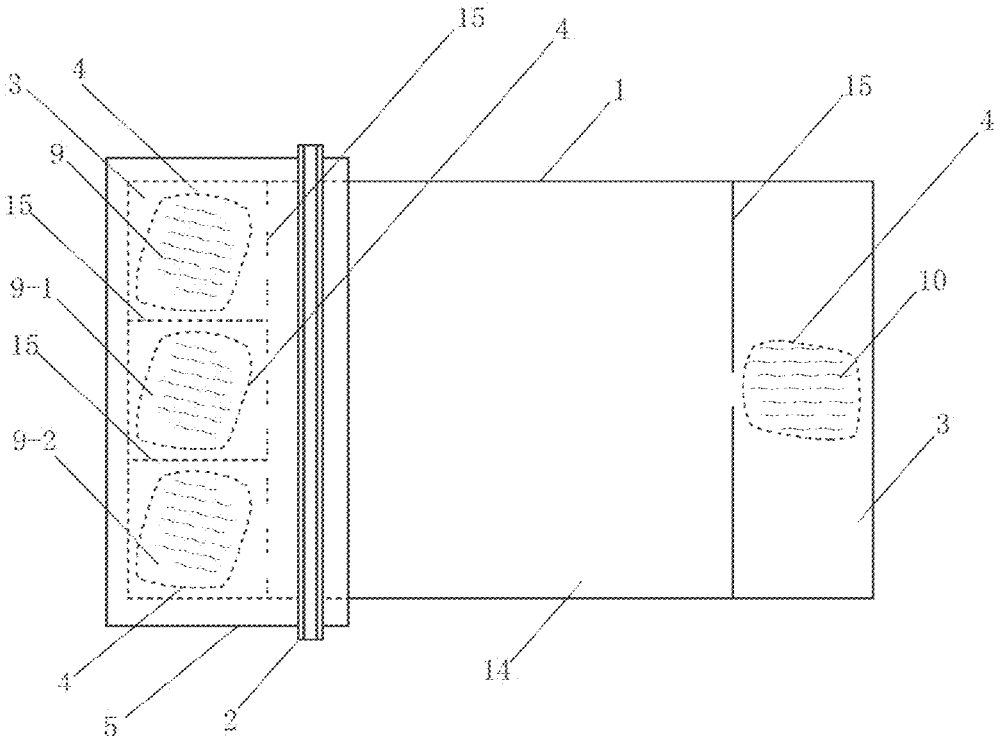
FIG. 6 is a top view of the chemiluminescent device with a single layer film.

As illustrated in FIG. 6, a top view of the chemiluminescent device with single layer film is shown. In the diagram, Part 1 is illuminant. Part 2 is division sealing device. Part 3 is chemical storage cavity. Part 5 is impermeable bag. Part 4 is breakable chemical storage bag, which contain luminescent agents (9) of the same or different colors and oxidizer (10), respectively. Part 14 is glowing reaction zone. Part 15 is separation line. The role Part 15 plays—limiting movement of the breakable chemical storage bag (4) and leading the flowing of the chemiluminescent chemical (61) in the breakable chemical storage bag to glowing reaction zone (14). In addition to setting separation line (15), breakable chemical storage bag also could be connected in chemical storage cavities (3), such as soldering Part 4 between the two layers of plastic film of Part 1, or Part 4 can be welded or attached to the inwall of chemical storage cavity. In this way, breakable chemical storage bag (4) also can be fixed. When using it, squeeze to break the breakable chemical storage bag (4) containing luminescent agents (9) and oxidizer (10) separately and drive two kinds of chemicals flow to the glowing reaction zone (14). Glowing takes place during the process of mixing. In addition to setting chemical storage cavity (3) at two ends of illuminant (1), they could be set at four sides of part 1. Some patterns could be printed on the surface of the part 1 in order to serve as a foil to the glowing inside.

As the glowing effect is achieved by a chemical reaction, when using this device, small amounts of gas will come into being in chemical storage cavities (3) that affect the glowing effect. The user is able to use division sealing device (2) (e.g., Seal Clip) to drive the gas to chemical storage cavity (3), where oxidizer (10) is sealed. Then the gas could be sealed in this cavity by Seal clip (2). Apart from this method, we also could set gas storage cavity or valves to store or release the gas. Solvent that contains carbonic ester could be used as the solvent for luminescent agents and oxidizer, such as dicaprylyl carbonate or dibutyl carbonate. Or sodium hydroxide kits can be set in illuminant (1) to get rid of the gas of carbon dioxide.

Figure 7:
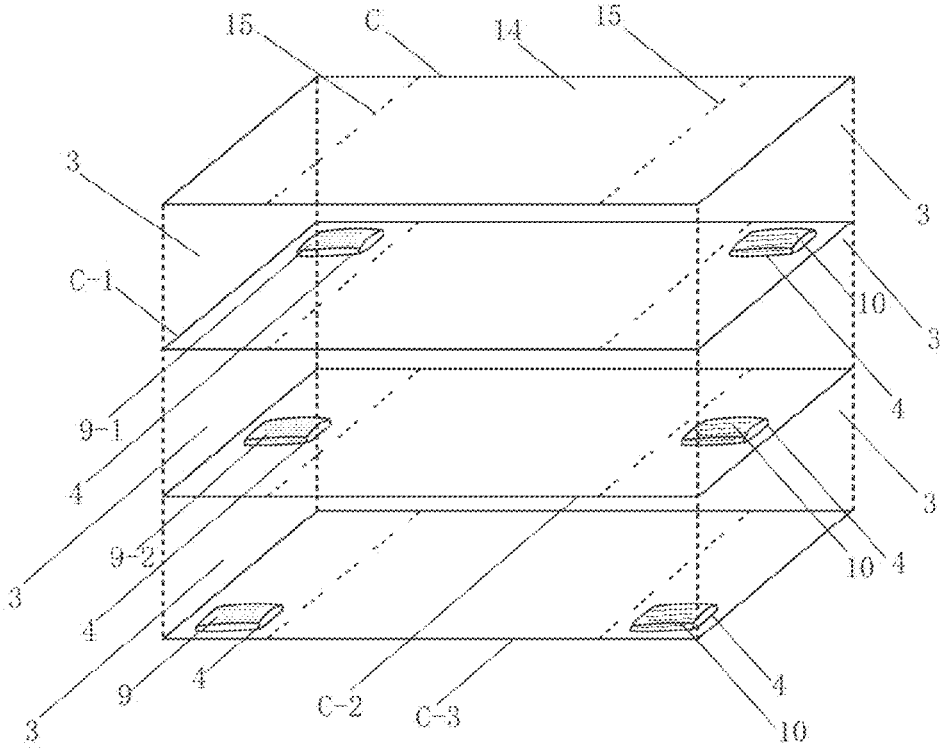
FIG. 7 is a dismantling schematic diagram of the chemiluminescent device that comprises multilayer plastic films.
Figure 8:
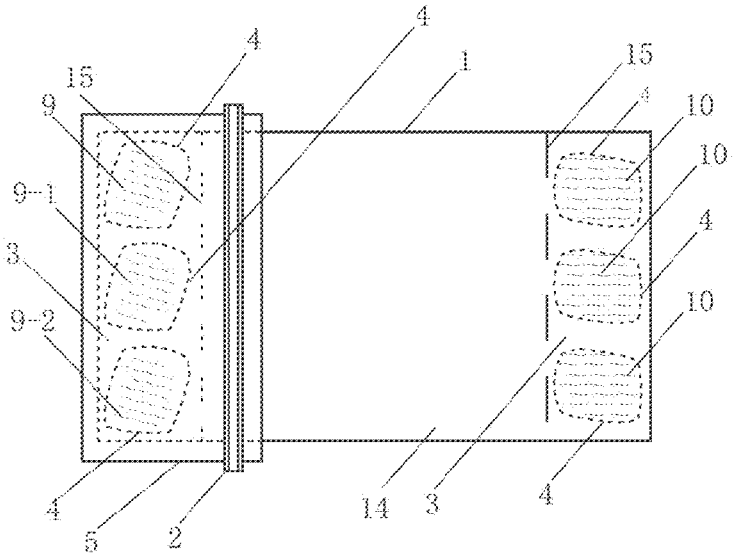
FIG. 8 is a schematic diagram of FIG. 7.

As illustrated in FIGS. 7 and 8, which show a schematic diagram of the device for glowing, and which consists of multilayer plastic films, FIG. 7 is a dismantling schematic diagram of FIG. 8. In the diagram, Part 1 is illuminant. Part 3 is chemical storage cavity. Part 14 is glowing reaction zone. Part 15 is separation line. Part 5 is impermeable bag. Part 2 is division sealing device. Part 4 is breakable chemical storage bag that contains luminescent agents (9) and oxidizer (10), respectively. In this device, illuminant (1) is the one with interlayers consisting of Part C, Part C-1, Part C-2, and Part C-3. C and C-1, C-1 and C-2, C-2 and C-3 respectively form chemical storage cavities (3). Shared plastic film of the layers is used in illuminant (1), which overlap each other. Chemical storage bags (4), that contain luminescent agents 9, 9-1, 9-2 with colors of red, yellow, blue and oxidizer (10), could be placed in chemical storage cavities (3). Glowing reaction zone (14) interconnects Part 3, while chemical storage cavities (3) in each layer do not interrupt each other; it is the same situation as for Part 14. Remove division sealing device (2) and impermeable bag (5), then squeeze to break chemical storage bags to make Luminescent agents (9) and oxidizer (10) mix with each other in glowing reaction zone (14). By using this device, each layer can maintain its color of glowing. Also, another kind of visual effect can be obtained via the overlapping. An effect of color changing could be realized by squeezing luminescent agents to change its position. Another way of implementing this device may come from two independent illuminants (1) overlapping each other. In this case, their glowing reaction zone (14) can be overlapping or separate, thereby they could be used independently or together.

In the above-mentioned implementation of this device, the shape of illuminant (1) can be a glove; also it could be a cap, plastic bag, mask, three-dimensional word, or life jacket, etc.

Figure 9:
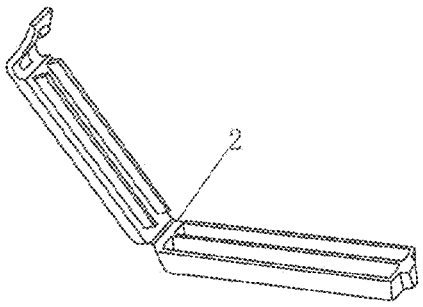
FIG. 9 is a schematic diagram of the seal clip.

As illustrated in FIG. 9, a schematic diagram of a seal clip is shown. In this implementation of the device, the described division sealing device (2) is the seal clip. In the diagram, there are upper parts and lower parts in the clip. Two tenons are set in the upper part of the clip. Accordingly, two mortises are set in the lower part of the clip. Lock catches are set at the openings of the clip. The opening part of impermeable bag (5) is placed between the upper part and the lower part of the clip. Then, the tenons are pressed into the mortises to make the upper part and the lower part of the clip engage closely. In this way, the opening part of impermeable bag (5) and internal part of illuminant (1) are sealed. When using it, the seal clip is tightly fastened on the outer surface of the impermeable bag.

Figure 10:
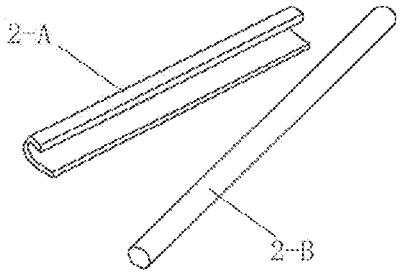
FIG. 10 is a schematic diagram of another kind of seal clip.
Figure 11:
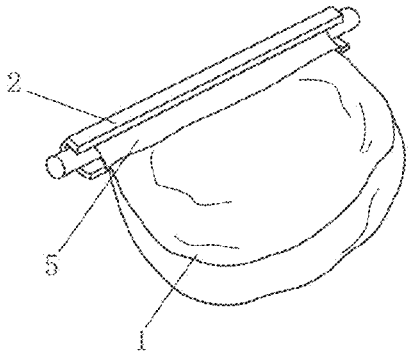
FIG. 11 is a using state schematic diagram of FIG. 10.

As illustrated in FIGS. 10 and 11, a split-type seal clip is shown, of which 2-A is a lock tube, and 2-B is a lock plunger. In production, illuminant (1) that contains chemiluminescent chemical (61) will be placed in impermeable bag (5). Then, hang the illuminant (1) and impermeable bag (5) on the lock plunger. In the end, chemical storage cavity (3) and impermeable bag (5) are sealed by the lock tube. When using the device, extract the lock plunger (2-B) and then make luminescent agents (9) and oxidizer (10) mix with each other in chemical storage cavities (3). The material of the seal clip could be plastic, rubber, metal, resin, etc. We can also make impermeable bag (5) like a ziplock bag. In practical production, illuminant (1) that contains chemiluminescent chemical (61) for glowing will be placed in impermeable bag (5), and then self seal the ziplock bag from the location outside the illuminant (1), where chemical storage cavities (3) division is needed.

Figure 12:
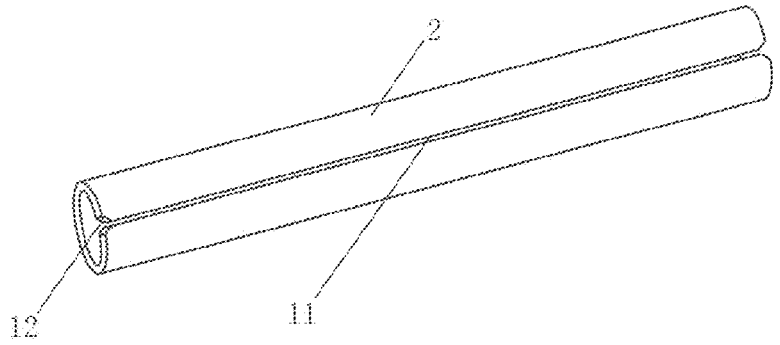
FIG. 12 is a schematic diagram of seal clip with the shape of "C".
Figure 13:
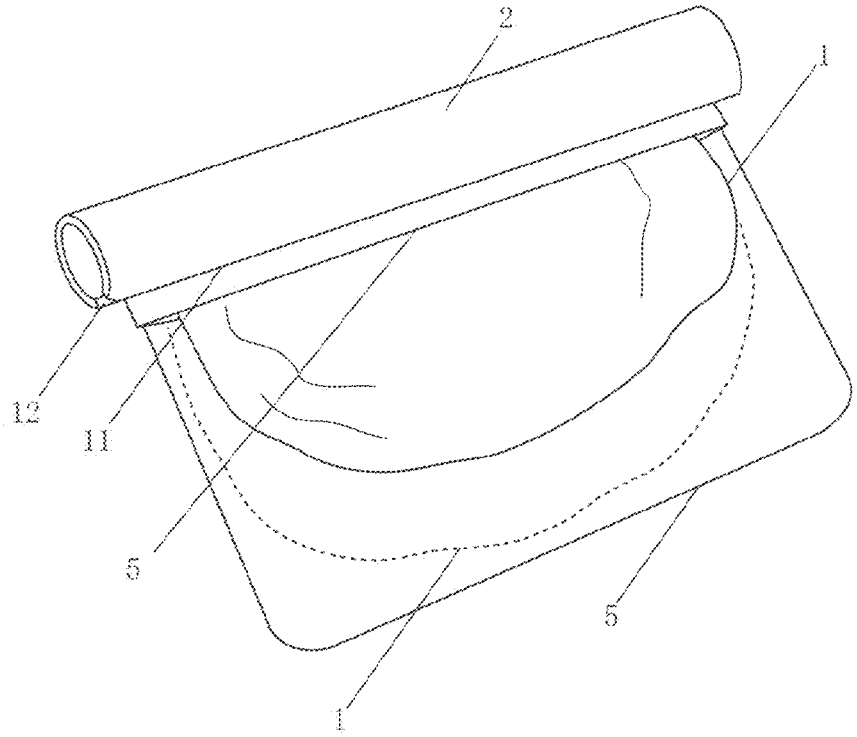
FIG. 13 is a using state schematic diagram of FIG. 12.

As illustrated in FIGS. 12 and 13, a slit (11) can be made according to the generatrix on the slip tube to make a seal clip with the shape of "C". Lead-in groove (12) can be set at both ends of the slit (11) in order to clip impermeable bag (5) more conveniently in production. In practical production, illuminant (1) that contains chemiluminescent chemical (61) will be placed in impermeable bag (5). Then, double over Part 5 at the seal, place it into Part 11 via the lead-in groove. Also, we could make one end of the part 11 sealed or one end of the seal clip closed. A design like this, not only can help prevent the impermeable bag (5) slipping out from the other end of the slit (11), but also could increase the clamping force of the slit.

In addition to the shape of "C", the seal clip could be round or polygon.

Figure 14:
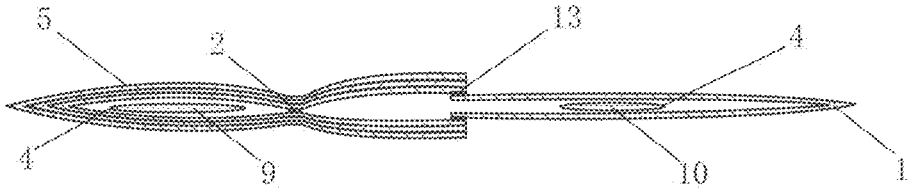
FIG. 14 is a cross-sectional view of chemiluminescent device with sealed separating device set inside.

As illustrated in FIG. 14, impermeable bag (5) is a cavity that is made by a composite of macromolecular material with aluminum foil, while illuminant (1) is a cavity that it is made by a macromolecule resin material, which is translucent. In the diagram, the composite of macromolecular material with aluminum foil is comprised of three layers. The material of the outer layer is BOPP, while the middle layer is aluminum foil, and the inner layer is PP. They will be combined into one layer in production. Illuminant (1) is a cavity that it is made by a translucent macromolecule resin material of PP. The edge of impermeable bag (5) and illuminant (1) will be connected and sealed via the structure (13) to ensure that cavity 5 and cavity 1 are linked together. Part 13 is a Thermo compression seal line or area sealed by a caking agent. Part 2 is a removable division sealing device. Part 9 is luminescent agents and Part 10 is oxidizer. Part 4 is breakable chemical storage bag. Luminescent agents (9) and oxidizer (10) are sealed in the chemical storage bags (4), respectively. In the implementation of the device, chemical storage bag (4) is a plastic capsule made from a macromolecule resin. In the diagram, the removable structure part 2 is a groove-shaped self sealing lock catch, which is set inside Part 5. In practical production, chemical storage bag (4) that contains luminescent agents (9) will be sealed in the cavity (5) via a self sealing lock catch and then chemical storage bag (4) that contains oxidizer (10) will be placed into the cavity of Part 1. In the end, Part 1 and Part 5 are solder sealed to make them connect with each other.

When using this device, squeeze to break the chemical storage bags (4), which are placed in the impermeable bag (5) made from a composite of macromolecular material with aluminum foil and the translucent cavity (1). At this moment, luminescent agents (9) and oxidizer (10) sealed in impermeable bags (4), respectively, are released. And then the self sealing lock catch and removable division sealing device (2) is opened to make the chemiluminescent chemical (61) mix with each other. The mixed chemiluminescent chemicals (61) can be driven to the translucent cavity Part 1, and the glowing could be achieved.

Apart from the removable division sealing device (2), such as self sealing lock catch, which is set in impermeable bag (5) that is made by a composite of macromolecular material with aluminum foil. We can also make the macromolecular material inside Part 5 closed and sealed temporarily by means of hot-pressure welding or conglutination. The hot-pressure welding or conglutination zone could be regarded as a removable division sealing device (2). Breakable chemical storage bag (4) sealed with luminescent agents (9) is isolated in impermeable bag (5) that is made by a composite of macromolecular material with aluminum foil. When the hot-pressure welding goes on, the temperature, time, and the pressure could be controlled. Or, the formulation of the glue and sizing way can be adjusted so as to open the zone to lift the sealing via imposing pressure outside the impermeable bag (5) or kneading lateral of Part 5. The described way of hot-pressure welding includes ultrasonic welding.

Figure 15:
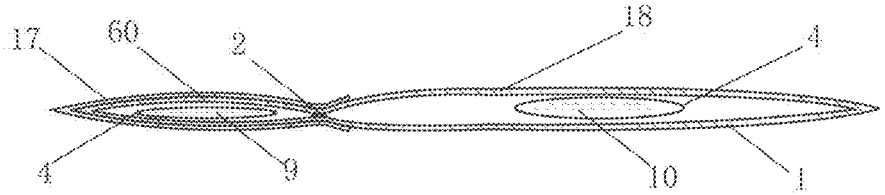
FIG. 15 is a cross-sectional view of a chemiluminescent device formed by a cavity that is made by transparent materials, and one end of the cavity is combined with aluminum foil.

As illustrated in FIG. 15, illuminant (1) is a continuous closed translucent cavity, which is made from PE film. Breakable chemical storage bag (4) sealed with luminescent agents (9) is placed in the area (60) on the left of the translucent illuminant (1). While Breakable chemical storage bag (4) sealed with oxidizer (10) is placed in the area (18) on the right of the translucent illuminant (1). Part 2 is the removable division sealing device, such as a self sealing lock catch, which is set between area (60) and Part 18 in translucent illuminant (1). It is set in the middle of the two breakable chemical storage bags (4). Part 17 is a layer of Aluminum foil. And it will be compounded with the left part of translucent illuminant (1), outside of area (60). The breakable chemical storage bag (4) sealed with luminescent agent (9) is placed in Part 60. Together with the removable division sealing device (2), the Aluminum foil is able to be used to wrap and seal the breakable chemical storage bag (4) that contains the luminescent agent (9) in order to make it impermeable and sealed. In practical production, other films made from macromolecular resin material such as PET, could be compounded with the Aluminum foil so as to increase the intensity of the foil. In the program, removable division sealing device (2) could also be a clip that is set outside the Aluminum foil (17), where it is between two breakable chemical storage bags (4)

It is the same with FIG. 14 when the above-described device is used.

Figure 16:
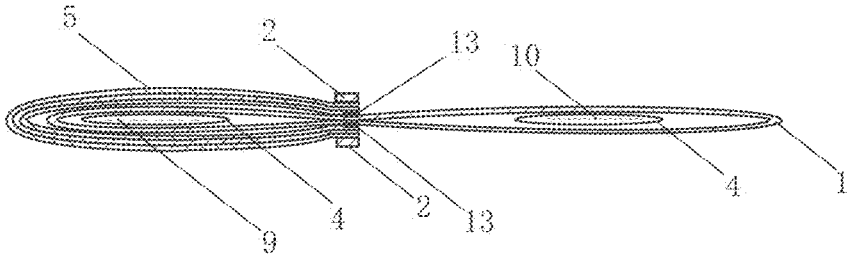
FIG. 16 is a cross-sectional view of chemiluminescent device formed by a cavity that is made by transparent materials, and another cavity made from composite of macromolecular material with aluminum foil is welded outside the cavity mentioned earlier.

As illustrated in FIG. 16, impermeable bag (5) is a cavity that it is made from a composite of macromolecular material with aluminum foil. In the diagram, the composite of macromolecular material with aluminum foil is comprised of three layers. The material of the outer layer is BOPP, while the middle layer is aluminum foil, and the inner layer is LLDPE. They will be combined into one layer in actual use. Illuminant (1) is a continuous closed cavity that it is translucent, and it is made from a thin-film material of LLDPE. Breakable chemical storage bag (4) sealed with luminescent agents (9) is placed within the area on the left of the translucent illuminant (1). While Breakable chemical storage bag (4) sealed with oxidizer (10) is placed within the area on the right of the translucent illuminant (1).

The left part of translucent illuminant (1), where the breakable chemical storage bag (4) is placed, is completely wrapped by impermeable bag (5). And the luminescent agent (9) is sealed in breakable chemical storage bag (4). And the opening of impermeable bag will be heat fused or conglutinated with the external surface of translucent illuminant (1). Connective sealing structure (13) is formed via the above-mentioned method of heat fusing or conglutination. Part 2 is a removable division sealing device that is set in place, where impermeable bag (5) is heat fused or conglutinated with the external surface of translucent illuminant (1). The removable division sealing device (2) is a clip.

It is the same with FIG. 14 when the above-described device is used.

Figure 17:
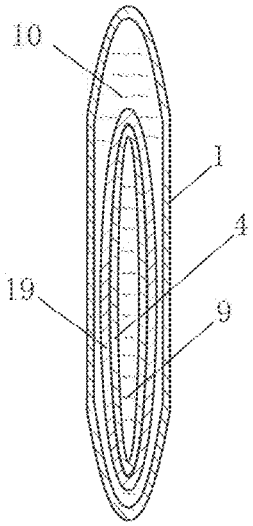
FIG. 17 is a cross-sectional view of chemiluminescent device with breakable chemical storage bag wrapped by aluminum foil.

As illustrated in FIG. 17, Part 1 is the illuminant. It is made from a translucent transformable PP sheet, the thickness of which is 0.65 mm. A sealed cavity is formed by heat sealing the periphery of the PP sheet. A breakable chemical storage bag (4) that is made from a macromolecule polymer film, is placed in this cavity. Luminescent agent (9) is sealed in the breakable chemical storage bag (4). And then breakable chemical storage bag (4) is wrapped by aluminum foil layer (19). The material of breakable chemical storage bag (4) could be FEP, PFA, PP, PE, PVC, PET, PVDC or MA-PVDC. The thickness of the described macromolecule polymer film is between 0.0001 mm and 0.3 mm, of which 0.01 mm-0.1 mm is the preferred option. In the implementation of the device, breakable chemical storage bag (4) is made from PE film, the thickness of which is 0.03 mm. Generally, chemiluminescent chemical (61) refers to luminescent agent (9) or oxidizer (10). In the implementation of the device, the liquid (i.e., luminescent agent 9) that contains ingredients such as oxalate is sealed in breakable chemical storage bag (4). Oxidizer (10) is sealed in the rest of the cavity in illuminant (1). Oxidizer (10) could be a liquid, but also could be a solid, such as urea peroxide.

The material of illuminant (1) also could be a thin film. The thickness of it is between 0.04 mm and 2 mm, of which 0.06 mm to 0.8 mm is the preferred option. The material also could be PE, PP, Nylon, PVC, PET, PVA, MA-PVDC, EVOH, PEN or a double-layer to multilayer composite made from two or more kinds of these materials. The sealed cavity is made from a translucent transformable PP sheet, the thickness of which is 0.65 mm. And it is formed by heat sealing the periphery of the PP sheet. An openable opening could be set on the cavity so as to discharge the glowing liquid after mixing to the outside of illuminant (1).

Figure 18:
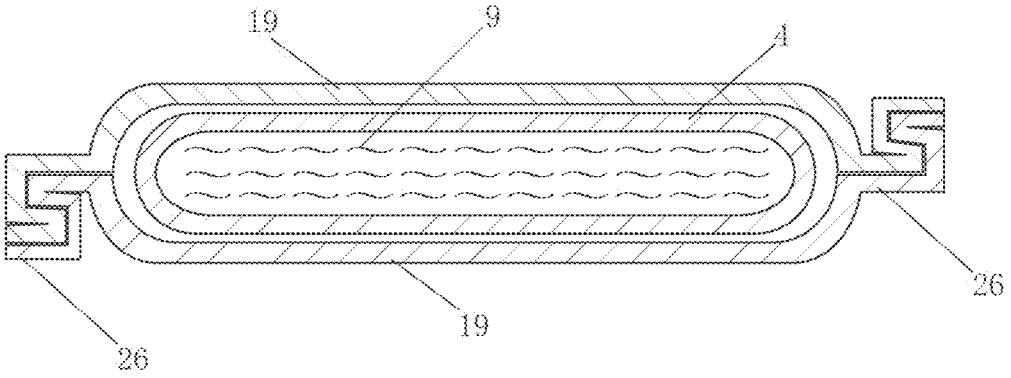
FIG. 18 is a schematic diagram of a breakable chemical storage bag wrapped by aluminum foil.

In production, the liquid (i.e., luminescent agent 9) that contains ingredients such as oxalate is sealed in breakable chemical storage bag (4). And the breakable chemical storage bag (4) is closely wrapped by an Aluminum foil layer (19), the thickness of which is 0.02 mm. The area of used Aluminum foil should be beyond the area occupied by breakable chemical storage bag (4). The part of Aluminum foil beyond the breakable chemical storage bag (4) should be tightly pressed, crimping sealed area (26) that is formed by repeatedly crimping and compressing the edge of Aluminum foil (as illustrated in FIG. 18). The role that the Aluminum foil layer (19) plays is isolating the breakable chemical storage bag (4) from the external environment.

In practical production, we could adopt multi-layer aluminum foil to wrap the breakable chemical storage bag (4) to make sure that it is more reliable for the sealing effect of the Aluminum foil layer (19). Breakable chemical storage bag (4) could be wrapped via multi-layer wrapping by one piece of Aluminum foil, also it could be wrapped repeatedly by several pieces of Aluminum foil. No matter whether it is a multi-layer wrapping or wrapped by several pieces, it is better to reserve adequate area for the edge of each layer or each piece of Aluminum foil to crimp and seal the edge of the outermost layer. The thickness of each layer of the Aluminum foil layer (19) could be between 0.001 mm and 0.2 mm. The thickness of the applied Aluminum foil is 0.06 mm in the implementation of this device. The preferred option for it should be between 0.006 mm and 0.09 mm. The breakable chemical storage bag (4) formed in this structure could contain chemiluminescent chemical (61) of 50 grams. And it also has a good performance of protection and mechanical strength.

When using this device, we can exert pressure inside the chemiluminescent device via illuminant (1). The Aluminum foil layer (19) is also deformed at this moment and then the pressure is transmitted to the breakable chemical storage bag (4). The film of breakable chemical storage bag is broken under the pressure, meanwhile, the Aluminum foil layer (19) is deformed and broken. Or the crimping sealed area (26) at the edge of Aluminum foil layer (19) is opened by the force from the internal pressure. The liquid of chemiluminescent chemical (61) outflows from the breakable chemical storage bag (4) so as to cause the liquid (i.e., luminescent agent 9), which contains ingredients such as oxalate in breakable chemical storage bag (4), to flow into the above-mentioned cavity to mix with oxidizer (10). Thereby, chemiluminescence is achieved.

Figure 19:
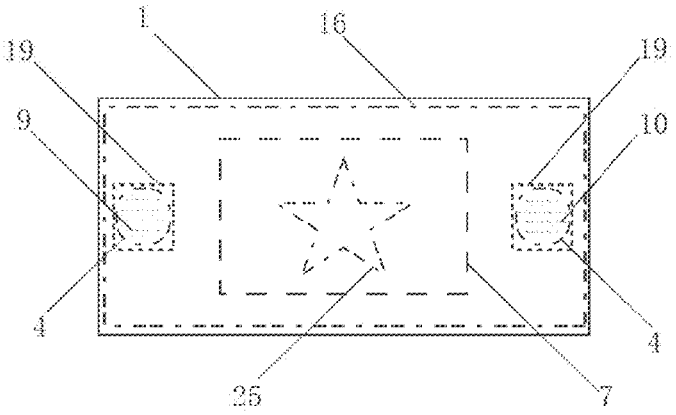
FIG. 19 is a schematic diagram of chemiluminescent device with image display function. Absorbent layer and light shielding layer are set inside this device.
Figure 20:
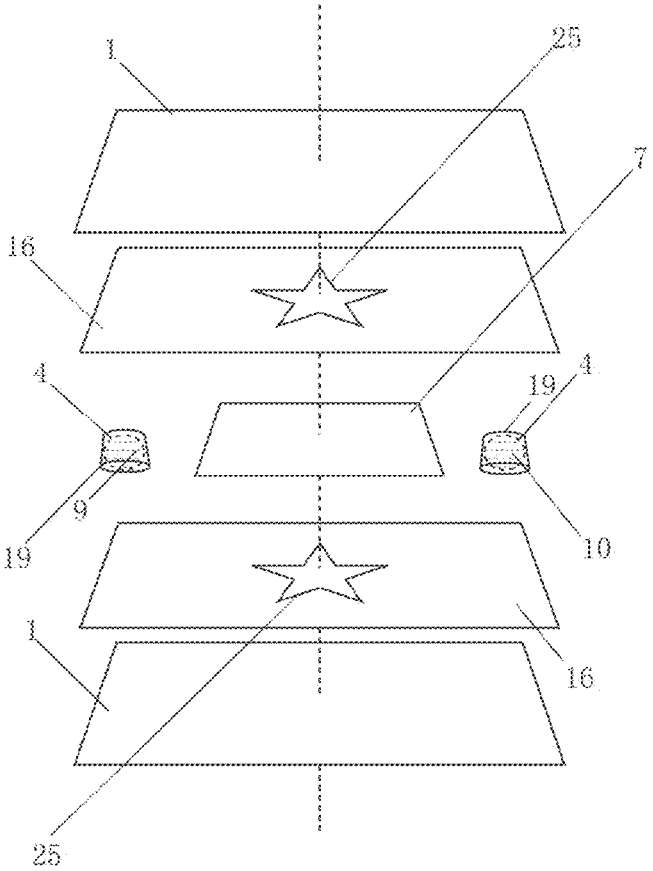
FIG. 20 is a dismantling schematic diagram of FIG. 19.

As illustrated in FIGS. 19 & 20, illuminant (1) is a shell made from a translucent composite thin-film, the inner layer of which is PE, while the outer layer is PET. The total thickness of the composite is 0.2 mm. The cavity is formed by solder sealing the periphery of the illuminant (1). Part 4 is a breakable chemical storage bag, in which chemiluminescent chemical is sealed. The outside of it is wrapped by Aluminum foil layer (19). In the implementation of this device, we could seal the liquid (i.e., luminescent agent 9), which contains ingredients such as oxalate, and oxidizer (10), respectively, into two breakable chemical storage bags (4) that are wrapped by an Aluminum foil layer (19). Then, two independent breakable chemical storage devices are formed. Part 16 is image showing device. Part 25 is hollowed out design set in the image showing device. In the implementation of this device, image showing device (16) is two pieces of laminate enchased in the pattern of five pointed star. The laminate is a light shielding layer made from opaque materials such as macromolecular materials, paper, or aluminum foil, etc. The cavity is formed by solder sealing the periphery of the illuminant (1). Absorbent layer (7) is set between the two image showing devices (16) in the cavity that is formed by solder sealing the periphery of the illuminant (1). The material of Absorbent layer (7) could be at least one of the following: fabric, Polypropylene non-woven fabrics, expanded material and paper. When using it, squeeze to break the breakable chemical storage bag (4) to allow the liquid (i.e., luminescent agent 9) that contains ingredients such as oxalate, and the oxidizer (10) to flow into the cavity of illuminant (1). These two kinds of liquid are absorbed by Absorbent layer (7) to mix with each other. Chemluminescence takes place while the mixing occurs. The image showing devices (16) are made from opaque materials, on which the pattern of five pointed star is enchased. Also, Absorbent layer (7) that absorbs luminescent liquid is set between the two pieces of opaque image showing devices (16). These ensure the chemiluminescence can only be sent out from the hollowed out design (25). In the implementation of this device, several breakable chemical storage bags (4) that are wrapped by an Aluminum foil layer (19) could be stacked, place order does not matter.

We can also adopt the composite of BOPP & PE, on which the colorful design is printed, as the image showing device (16). In this way, when it is used, the design on image showing devices (16) will be lighted up by the glowing chemiluminescent liquid. And the image of the design will be emitted from the cavity that formed by solder sealing the periphery of the illuminant (1) to the surface of it. The above-mentioned printing layer could be set on the surface of the interlayer of the two layers of composite.

In order to enhance the sealing performance of breakable chemical storage bag (4) to isolate it from moisture in the external environment effectively, we can get the crimping sealed area (26) of breakable chemical storage bag (4) or Aluminum foil layer (19) soaked in sealing materials. The available sealing materials could be paraffin, low-molecular-weight PE, epoxy resin, petroleum-based grease with high-consistency, silicone waxes, polyurethane binder, etc. And these solidified sealing materials must be breakable under an external force. For example, when it comes to production, the breakable chemical storage bag (4) could be placed into melted wax totally, so as to fill the gap of crimping sealed area (26) with liquid wax while covering the surface of the aluminum foil layer (19). And then, take breakable chemical storage bag (4) out & place it at room temperature so as to solidify the wax on the surface of the aluminum foil layer (19) and the crimping sealed area (26) in order to form the sealing layer. Also, we could merely get the crimping sealed area (26) of breakable chemical storage bag (4) soaked in melted wax to fill and seal the gap. As the solid wax is breakable, it will not affect the release of internal chemiluminescent chemicals.

The external surface of breakable chemical storage bag (4) could be wrapped with a non-closed macromolecule polymer film in order to avoid the taper angles formed in the crimping sealed area (26) piercing illuminant (1). Also the external surface of aluminum foil layer (19) could be covered by thermal shrinking tube. However, there must be a gap or opening for wrappage to ensure that the liquid can flow out after breaking the device.

In the above-mentioned device, pointed or sharp objects can be placed into the cavity formed by solder sealing the periphery of the illuminant (1) in order to puncture or cut breakable chemical storage bag (4) when pressure is exerted from the outside of the illuminant (1). In this way, chemiluminescent chemical (61) sealed in the breakable chemical storage bag (4) could be released into the cavity, which is formed by solder sealing the periphery of the illuminant (1).

The burst opening area is set on the above-mentioned breakable chemical storage bag (4) that is made from a macromolecule polymer film. It could be a thinner pre-treated film or the notch not penetrated on the surface of breakable chemical storage bag (4). Also it could be an easily opened solder welding sealing line obtained when solder welding the edge under adequate welding time, temperature and pressure. Or it could be sealing opening, formed via welding the matched sealing groove on the inner surface of the film.

Figure 21:
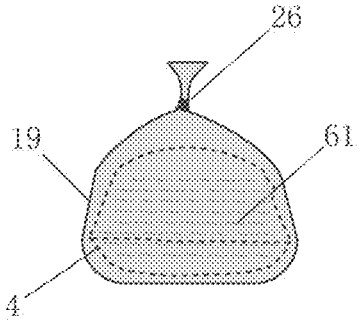
FIG. 21 is a schematic diagram of another kind of sealed cavity wrapped by aluminum foil layer.

As illustrated in FIG. 21, in practical production, apart from the above methods of wrapping, we also can directly place breakable chemical storage bag (4) that contains chemiluminescent chemical (61), i.e., luminescent agent (9) or oxidizer (10), on the middle of a piece of aluminum foil. Then lift the periphery of the aluminum foil so as to wrap the breakable chemical storage bag (4). Screw the upper part of the aluminum foil to form the aluminum foil layer (19), in order to achieve the purpose of sealing breakable chemical storage bag (4). At the moment, the screwed upper part can be regarded as crimping sealed area (26).

Figure 22:
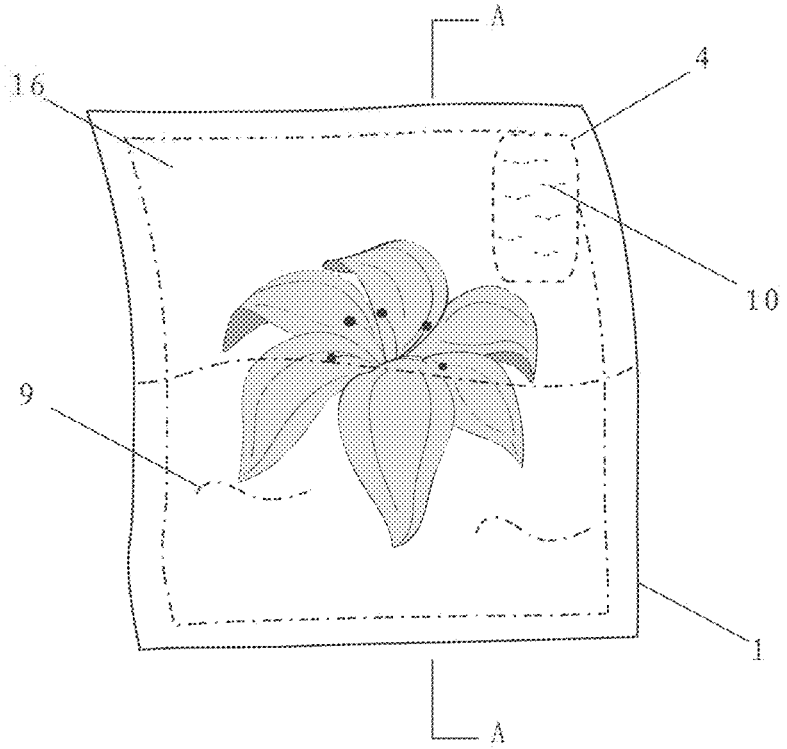
FIG. 22 is a schematic diagram of chemiluminescent device, the shell of which is made from thin film.

As illustrated in FIG. 22, the cavity formed by a transparent sealed shell is illuminant (1), and it is a bag, which is made from a material of transparent polymer PP. The liquid (i.e., luminescent agent 9) that contains ingredients such as oxalate and the oxidizer (10) are sealed in the inside of the cavity. Oxidizer (10) is placed in breakable chemical storage bag (4). The liquid that contains ingredient such as oxalate, i.e., luminescent agent (9) is directly placed into the cavity, which is made from transparent sealed illuminant (1). The material of breakable chemical storage bag (4) is polymer PE. It is a capsule that is formed via enclosing and welding the periphery. The thickness of it is between 0.001 mm and 0.006 mm, so it is easily broken under external pressure. Image showing device (16) is also sealed in illuminant (1) and unfolded in it. Image showing device (16) is a piece of composite film, which comprises one piece of BOPP film with a colorful design of a flower printed on the surface and PE film. The colorful design of a flower is printed on the BOPP film, and then it is compounded with PE film. The thickness of both BOPP film and PE film is 0.004 mm. When using it, squeeze to break the breakable chemical storage bag (4), so as to make oxidizer (10) flow out to meet the liquid (i.e., luminescent agent 9) that contains ingredients such as oxalate. Then the glowing can be achieved. Meanwhile, glowing liquid flows to two sides of the Image showing device (16) to immerse it rapidly. In the implementation of the device, the liquid (i.e., luminescent agent 9) that contains ingredients such as oxalate, contains mixed fluorescent agents of blue, red, yellow and green, and then glowing of a white color comes into being.

Figure 23:
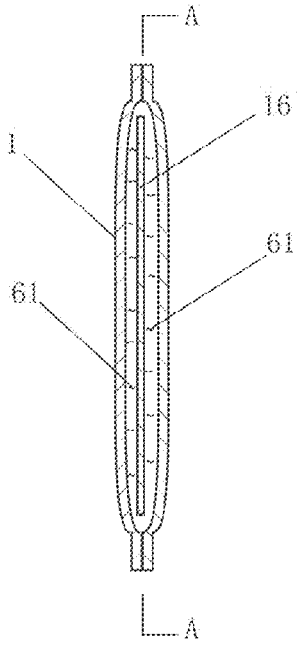
FIG. 23 is a cross-sectional view of chemiluminescent device used in FIG. 22 & FIG. 25.

As illustrated in FIG. 23, a cross-sectional view of the implementation of the device is shown. It can be seen from FIG. 23 that the image showing device (16), for which the composite film is used as a carrier, is totally immersed in chemiluminescent chemical (61). At this moment, the colorful design of a flower on the image showing device (16) can be lighted up by the white light sent out from the liquid of chemiluminescent chemical (61). The image of the design is sent out via the surface of illuminant (1), while the colorful glowing flower could be seen from both sides.

The described image showing device (16) could also be a macromolecule film material in addition to the mentioned materials in the above implementation of the device. They also could be PP, PE, PVC, polyester (PET) or a double-layer to multi-layer composite of at least two of them. It is feasible that paper with images printed thereon, a composite of paper and a macromolecule film, non-woven fabrics, or glass fabric can be used as image showing device (16). The glowing effect of image showing device (16) is outstanding while it is made from knit, glass fabric with image embroidered on, nylon fibrous reticulum, or terylene. The image showing device (16) also can be knitted paper, non-woven fabrics, and fibrous material. Also, it could be multi-layer composite of either one kind of material or a variety of different materials. The fibrous material can be inorganic or organic. Inorganic material could be fiber glass. Organic material could be cotton fiber or fibrous material made from a macromolecule polymer. Apart from the method for enchasing image showing device (16) to form the pattern, we can also obtain the pattern on image showing device (16) via changing the density of partial areas, when the material is chosen from paper, non-woven fabrics, and fibrous material. For example, the pattern can be obtained by means of watermarking technology on paper or heat pressing on non-woven fabrics or macromolecule fibrous material. Or three-dimensional patterns could take shape on image showing device (16) by way of high-pressure die, folding or collage. In this way, glowing images can be seen via the reflection from the illuminant (1). When the fiber materials are used, image showing device (16) could be obtained by means of knitting, spinning or embroidering the fiber of different colors.

In the implementation of this device, the material of breakable chemical storage bag (4) also could be composite of macromolecular materials with aluminum foil. It is also a good choice for making breakable chemical storage bag (4). The problem is that there is a shadow left on the area of image showing device (16). The total thickness of the above mentioned materials is between 0.0001 and 0.1 mm.

In the implementation of this device, the liquid (i.e., luminescent agent 9) that contains ingredients such as oxalate also could be sealed in another breakable chemical storage bag (4). It is more propitious to the extension of products' storage period. Meanwhile, several breakable chemical storage bags (4) may contain luminescent agents (9) of different colors. On one hand, it could enrich the performance of colors, and on the other hand, it could extend the time of glowing by means of successive using.

Figure 24:
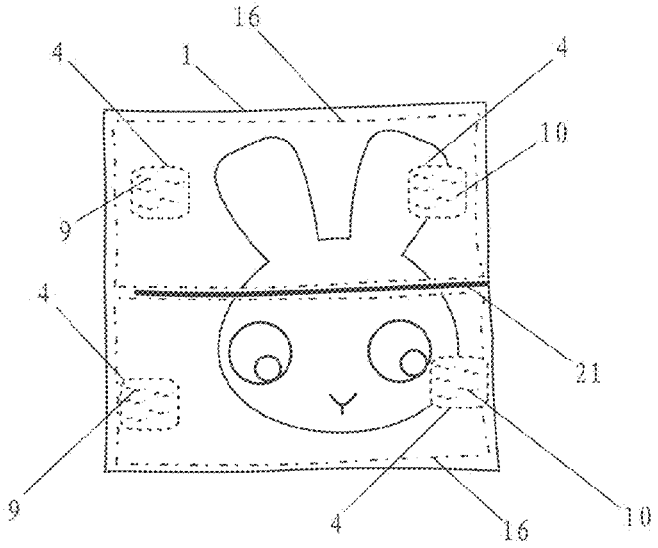
FIG. 24 is a schematic diagram of one kind of chemiluminescent device with heat-pressing division line.

As illustrated in FIG. 24, a chemiluminescent device with heat-pressing dividing line (21) is shown. The cavity formed by transparent sealed film is illuminant (1), and it is a bag, which is made from material of transparent macromolecular PE. In the middle of the illuminant (1), there is a heat-pressing division line (21) that divides the cavity of illuminant (1) into upper and lower parts. The right side of the heat-pressing division line is heat sealed with one of the vertical edges of illuminant (1), while the left side of the heat-pressing division line is not heat sealed. A passage is set aside to enable two cavities that are divided by heat-pressing division line (21) to communicate with each other. Image showing devices (16) are two pieces of 100% white wood pulp paper of 60 gram per square meter with the upper and lower parts of a rabbit design respectively printed thereon. And the two pieces are respectively placed in the cavities of illuminant (1), which are formed via heat-pressing division line (21). The rabbit pattern is comprised of upper and lower parts. Two breakable chemical storage bags (4) sealed with oxidizer (10) are placed in the right of upper and lower parts of the cavities. While two breakable chemical storage bags (4), which contains liquid (i.e., luminescent agent 9) that contains ingredients such as oxalate, are placed in the left of the cavity. The breakable chemical storage bags (4) are capsules made from macromolecular PP via sealing & welding the periphery. The thickness of the material is 0.002 mm. When using this device, squeeze to break all of the breakable chemical storage bags (4), so as to make oxidizer (10) flow out to meet the liquid (i.e., luminescent agent 9) that contains ingredients such as oxalate, then the glowing can be achieved & the pattern of a rabbit could be mapped out. What differs from FIG. 22 is that there is a heat-pressing division line (21). Its function lies in that it could head off the glowing liquid, when holding the left of the chemiluminescent device in vertical direction by hand and then the right part will fall slightly. So as not to let most of the liquid flow to the lower right corner of the device to make sure the glowing effect of the overall pattern is better. The left side of the heat-pressing division line (21) is not heat sealed in order to leave a passage between upper and lower cavities, so that liquids can be mixed completely. If there is no need to leave a passage, then two completely independent cavities are set in the device. The chemiluminescent device with heat-pressing division line (21) is more suitable for the chemiluminescent devices which has larger area & used in a vertical direction. If a more heat-pressing division lines (21) are used to divide the chemiluminescent device into more cavities, it is more obvious to see the effect of preventing the liquids to flow down. However, the image showing device will be divided into more pieces, in this case, the overall effect will be affected.

In the above-mentioned implementation of the device, if image showing device (16) is made from a macromolecular film, macromolecular non-woven fabrics or a composite of paper & macromolecular film, and the pattern is printed on the surface of these materials, there is no need to divide the whole pattern into several pieces to place them into cavities. We can put the above-mentioned image showing device (16) into the bag made from macromolecular materials, then heat pressing two surfaces of the bag outside to get the heat-pressing division lines (21). It also works to get several cavities to head off the liquids to flow down.

Figure 25:
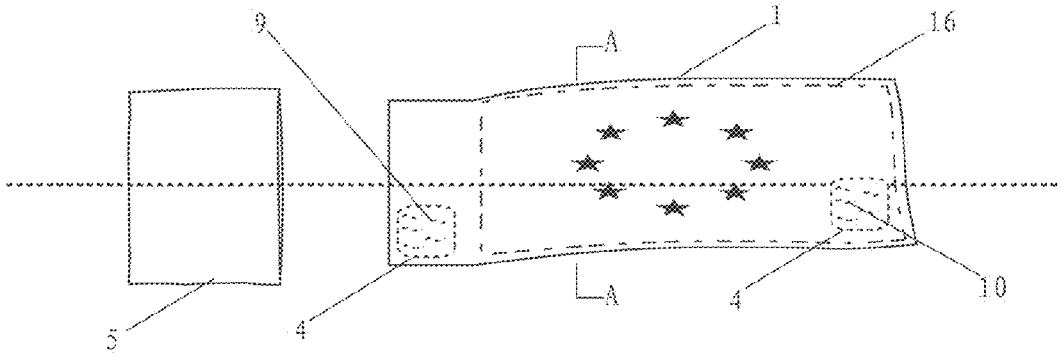
FIG. 25 is a schematic diagram of a flag-shaped chemiluminescent device.

As illustrated in FIG. 25, a chemiluminescent device having a flag shape is shown. The cavity formed by a transparent sealed shell is illuminant (1). It is a transparent rectangular bag, the thickness of which is 0.02 mm. The material of the inner layer is a macromolecular PE, while the outer is PET. Image showing device (16) that is made from paper is placed in the rectangular bag. It covers 80-90% of the area of the bag from the right side to left. The star patterns of the flag are symmetrically printed on both sides of the paper. Chemical storage bag (4) sealed with oxidizer (10) is placed at the lower right corner of the image showing device (16). One breakable chemical storage bag (4), which contains liquid (i.e., luminescent agent 9) that contains ingredients such as oxalate, is placed at the left side of the remaining 10-20% of the area of the rectangular bag. The material of breakable chemical storage bag (4) is a macromolecular PE. It is a capsule that is formed via enclosing and welding the periphery. The thickness of it is 0.002 mm. In the above-described position, there is image showing device (16) that is made from paper, on both sides of which the star patterns of the flag are symmetrically printed. Also, there are two capsules. In one of them, oxidizer (10) is sealed.

Figure 26:
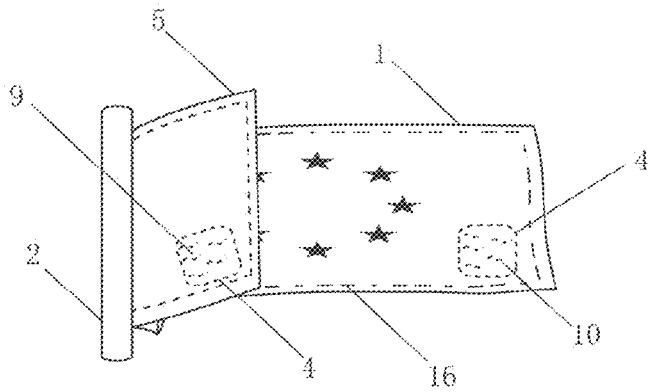
FIG. 26 is a schematic diagram of flag-shaped chemiluminescent device and impermeable bag sealed by tubular clip.
Figure 27:
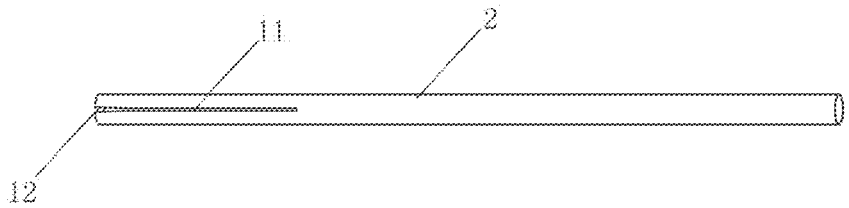
FIG. 27 is a schematic diagram of a long-stem tubular clip with the slit.
Figure 28:
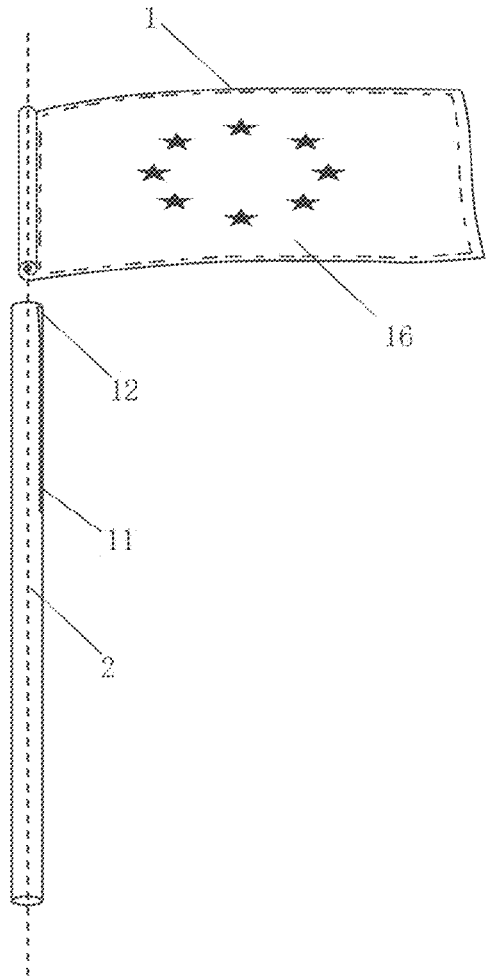
FIG. 28 is a using state schematic diagram of the long-stem tubular clip used as flagpole.

And in the other, liquid (i.e., luminescent agent 9) that contains ingredients such as oxalate is sealed. When it comes to final sealing for the opening, a vacuum pumping sealing machine could be used so as to exclude the air in illuminant (1). After the sealing, at the left side of the rectangular bag, i.e., the position where the capsule is sealed with liquid (i.e., luminescent agent 9) that contains an ingredient such as oxalate is placed, an impermeable bag (5) can be used to wrap the left part. The bag is made from a composite of macromolecular materials with aluminum foil & three edges of it are sealed. It is feasible the length of impermeable bag (5) should be a bit longer than the area where the capsule sealed with a liquid (i.e., luminescent agent 9) that contains an ingredient such as oxalate is placed. A tubular clip with the slit (11) could be used as removable division sealing device (2). As illustrated in FIG. 26, fold back the rectangular bag and impermeable bag (5) and then insert them into the slit (11) for sealing. Also, as illustrated in FIG. 27, long-stem removable division sealing device (2) can be a proper substitute for the clip with slit (11). In fact, the removable division sealing device (2) in FIG. 27 is a lengthened clip with slit (11). Moreover, there is a lead-in groove (12) at the leading end of the slit. When using the device, remove the clip and impermeable bag (5), and then squeeze to break the capsule in which the liquid (i.e., luminescent agent 9) that contains an ingredient such as oxalate is sealed while also breaking the capsule that contains oxidizer (10) to mix the chemiluminescent chemicals for glowing. After evenly glowing, a flag that glows from both sides can be obtained. Then, as illustrated in FIG. 28, the left part of the bag without image showing device (16) could be rolled up and inserted into the lengthened clip with slit (11) via lead-in groove (12). The lengthened part could be used as flagpole for hand-holding or fixing.

Figure 29:
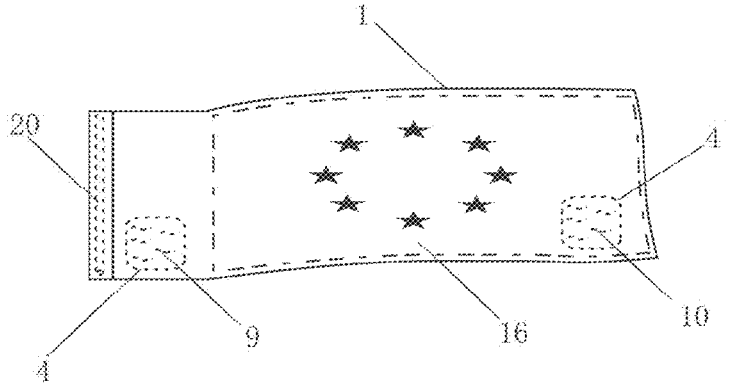
FIG. 29 is a schematic diagram of a flag-shaped chemiluminescent device with supporting fixture.

Also, as the chemiluminescent device illustrated in FIG. 29, supporting fixture (20) is set in the left part of rectangular bag formed by illuminant (1). Herein, supporting fixture (20) is a thin rod welded & sealed in the left-most side of the rectangular bag. In this case, the thin rod could be taken as an axis to roll up the left part of the bag, where there is no image showing device (16). And then they could be inserted into the long-stem clip via slit (11).

In addition, supporting objects such as iron wire, plastic sticks or bamboo pole can be fixed in the frame or surface of rectangular bag formed by illuminant (1) in order to increase the non-deformability of the shell made from thin film. Iron wire or other materials with some shapes can make the flag-shape chemiluminescence device keep a certain desired shape.

The role of impermeable bag (5) made from a composite of macromolecular materials with aluminum foil & the removable division sealing device (2) had played is isolating the moisture in the air in order to extend the shelf life of the liquid (i.e., luminescent agent 9) that contains an ingredient such as oxalate. In the above chemiluminescent device, independent breakable chemical storage bag (4) that is enclosed by a composite of macromolecular materials with aluminum foil, could be used. Or at the area in closed illuminant (1) where the breakable chemical storage bag (4), which is sealed with liquid (i.e., luminescent agent 9) that contains an ingredient such as oxalate, is placed, the macromolecular film material of illuminant (1) can be directly compounded with aluminum foil (17) to form impermeable bag (5). Removable division sealing device (2) is set at the external or internal of the impermeable bag (5), at the edge of which breakable chemical storage bag (4) that contains oxidizer (10) is placed. Removable division sealing device (2) here could be trough-shaped mutually occluding seal welding on the inner surface of illuminant (1). According to the two methods described above, the shelf life of the liquid (i.e., luminescent agent 9) that contains an ingredient such as oxalate, also could be extended, while the purpose of using this device can be achieved. Also, breakable chemical storage bag (4) could be wrapped by an aluminum foil layer (19) so as to isolate the moisture in the air. In this way, impermeable bag (5) & division sealing device (2) can be saved. If no spare place remains in the left of the rectangular bag formed by illuminant (1), we could place the breakable chemical storage bag (4), which is sealed with a liquid (i.e., luminescent agent 9) that contains an ingredient such as oxalate, directly at the area of image showing device (16). The glowing effect of the pattern is also splendid, when the material of breakable chemical storage bag (4) is a transparent macromolecular film. However, if it is a composite of macromolecular materials with aluminum foil, the shading problem appears because of the opaque aluminum foil. Thereby, it results in a shadow in this chemiluminescent device.

When the flag-shaped chemiluminescent device, which is described in FIG. 25, is used in a vertical direction, its cross-sectional view is the same as FIG. 23. It can be seen in FIG. 23, there is image showing device (16) that is made from paper, on both sides of which the star patterns of the flag are symmetrically printed. It is soaked in chemiluminescent chemicals (61). The stars' pattern and the whole surface of flag are lighted up by the glowing chemical agents. The image of the design is sent out via the surface of the bag formed by illuminant (1), while the glowing flag could be seen from both sides. It is necessary to prevent the glowing liquid from flowing down to lower part of the flag, as it is used in a vertical direction. Herein, there are several factors to minimize the down sliding of glowing liquids. The first factor is that an absorbing layer between the chemiluminescent chemical (61) and image showing device (16) had absorbed a portion of the liquid. The second one is the intensity helps the illuminant (1) hold part of the chemiluminescent chemical (61). The third one is that a vacuum sealing technology is used when sealing the bag formed by illuminant (1). Most of the air is excluded. On one hand, the bag formed by illuminant (1) is pressed tightly by the atmospheric pressure; on the other hand, the inner space of the bag can be filled with chemiluminescent chemical (61) as much as possible.

Figure 30:
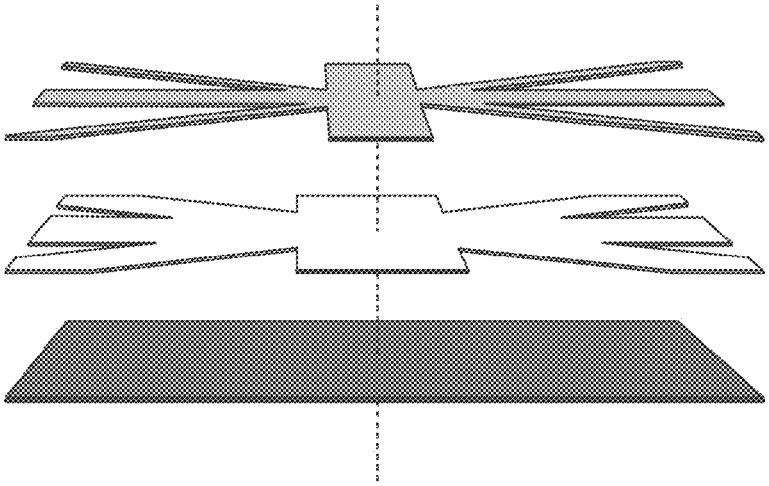
FIG. 30 is a schematic diagram of an image showing a device made from a collage with the Union Jack style.

As illustrated in FIG. 30, an image showing device (16) with the Union Jack style made from a three-color collage is shown. There are three layers of red, white and blue from top to bottom. The layers are formed by several pieces of tinct PET film. They can be placed in a transparent closed cavity formed by illuminant (1) as described above in FIG. 25. Also, they could be placed into three cavities formed by illuminant (1). In the end, three transparent illuminants (1) made from thin films could be stacked together to form the glowing image. When image showing device (16) is comprised of three layers and placed into three cavities formed by illuminant (1), the color of chemical agents in respective cavities could be red, white, and blue. The material of image showing device (16) can be white paper. Then the effect of a bright Union Jack could be obtained.

Figure 31:
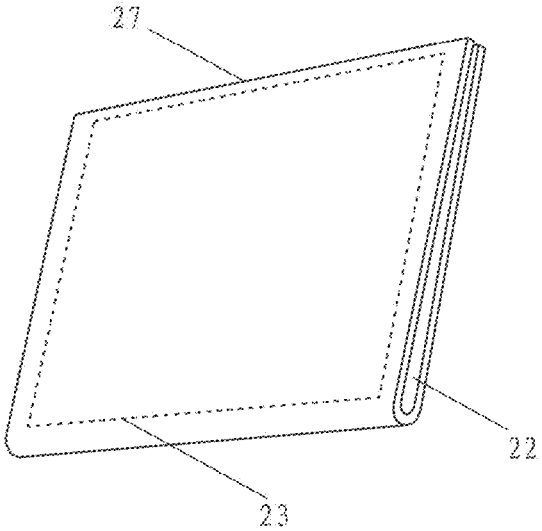
FIG. 31 is a schematic diagram of an integrative chemiluminescent device that provides an encapsulating space within a barrier made from thin film

As illustrated in FIG. 31, part 27 is a shell. Part 22 is a contained space set in part 27. In the implementation of this device, the shell (27) is a flaky object with a plane surface to form a U-shaped shell via folding. The U-shaped space is a contained space (22). It is certain that the flaky object with a plane surface can be replaced with a flaky object with a curved surface. Part 23 is a chemiluminescent component made from thin film. It is a transparent bag with a cavity enclosed by a film that is made from a macromolecule PP chemiluminescent chemical (61) sealed in the inner of cavity. The chemiluminescent chemical (61) could be an ingredient that contains oxidizer (10) and a liquid (i.e., luminescent agent 9) that contains an ingredient such as oxalate. The structure & operating mode of the chemiluminescent component (23) are the same with chemiluminescent devices illustrated in FIG. 1, FIG. 2, FIG. 6, FIG. 14, FIG. 15, FIG. 16, FIG. 17, FIG. 19, FIG. 20, FIG. 22, FIG. 24, and FIG. 25. The air in chemiluminescent component (23) can be excluded via a vacuum pumping machine so as to adjust it to the contained space (22). When using this device, the user only needs to clip chemiluminescent component (23) via contained space (22) inside the shell (27). The height of the contained space could be designed to be lower than that of chemiluminescent component (23) in order not to make Part 23 slide out from contained space (22) because of the big space in part 22. So, when using it, we can make use of Shell (27)'s intensity to clip the chemiluminescent component (23) tightly in contained space (22). When the material of Shell (27) is elastic or has good performance of deformation, we can set the height of contained space (22) higher or equal to zero. In this way, while using the device, the flowing liquids could be clipped tightly in the contained space to prevent glowing liquids in chemiluminescent component (23) from flowing down to affect the glowing effect because of gravity.

In order to make the glowing effect more prominent, when using this device, the material of shell (27) could be a transparent or translucent glass or plastic, such as PE, PP, HDPE, LDPE, LLDPE, PVC, GPPS, AS, SAN, ABS, PMMA, EVA, PET, PBT, PA, PC, POM, PPO, PPS, PU, AS. Also, the material of shell (27) could be chosen from an opaque metal, paper, pottery and porcelain, etc. When opaque materials are used, we can enchase characters or designs of plants, animals such as a bear, rabbit, birds, etc., on the shell. In this way, glowing patterns of animals and plants can be shown in the shell (27). In the implementation of this device, the shell (27) is rectangular. Other shapes also could be used for shell (27), such as a circle, square figure, triangle, polygon, toroidal shape, etc. in geometric figures. It is certain planar configurations, such as a cup, wine bottle, animal, plant, etc., can be used for shell (27). If other shapes are adopted for shell (27), the chemiluminescent component (23) can be made into corresponding shapes. By this way, glowing patterns could be displayed better to get a preferable glowing effect.

Figure 32:
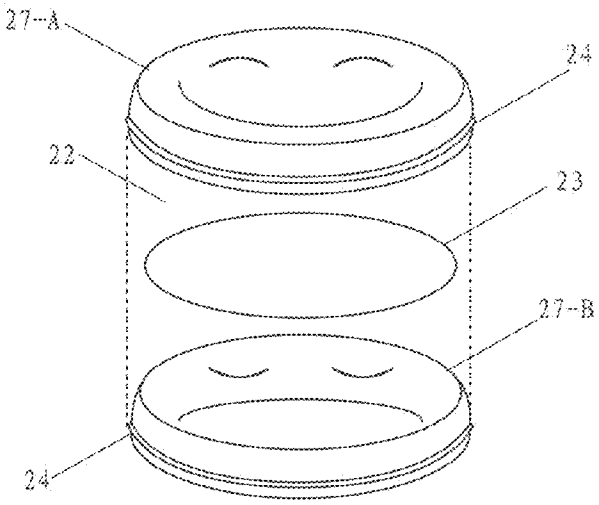
FIG. 32 is a schematic diagram of a chemiluminescent device that provides an encapsulating space within a barrier made from thin film, on which connecting device is set.

As illustrated in FIG. 32, shell (27) is comprised of two disk-shaped shells 27-A & 27-B with a flange. Part 24 is a slot-type connecting device set on the flange of disk-shaped shells 27-A & 27-B. In practical production, connecting device (24) could be removed. Disk-shaped shell (27-A) is able to be connected with Part 27-B via conjunction of the two flanges' (such as friction, spiral connection). Part 23 is the chemiluminescent component. When using this device, the user only needs to put the glowing chemiluminescent component (23) into the space between disk-shaped shell 27-A and 27-B. And the two disk-shaped shells can be fixed together via connecting device (24), then this device can be used. The contained space (22) is formed while disk-shaped shell 27-A is fixed with 27-B. In the implementation of this device, a smiling face is printed on the surface of the disk-shaped shell 27-A, while a sad expression is printed on 27-B. When using this device, different expressions can be seen on the two surfaces of the device. It is sure that we also could add no printing patterns on it, while the user can make a doodle or DIY written works via a mark pen or whiteboard pen. This device also could be a square figure, triangle or polygon. The above-mentioned connecting device (24) can also be a buckle comprised of a bump slot on two plain disk-shaped shells. The buckle can be locked tightly when the bump slot is fixed well.

Figure 33:
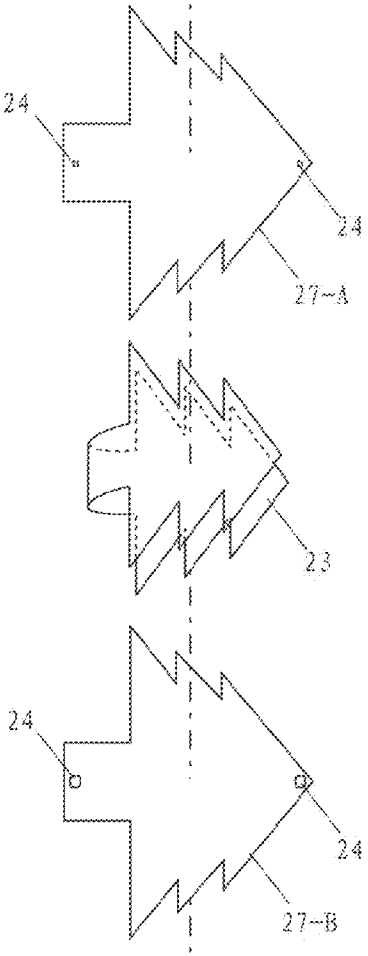
FIG. 33 is a schematic diagram of a chemiluminescent device that provides an encapsulating space within a barrier made from thin film, in which the chemiluminescent component with mirror symmetrical pattern is set.
Figure 34:
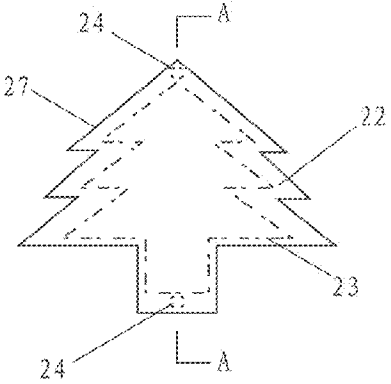
FIG. 34 is a using state schematic diagram of FIG. 33.
Figure 35:
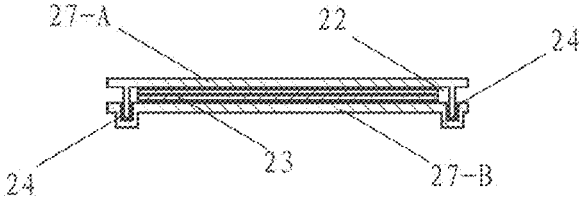
FIG. 35 is a cross-sectional view of FIG. 34 along line A-A.

As illustrated in FIG. 33, 34, 35, the shell (27) is comprised of two tree-shaped shells 27-A & 27-B. Part 24 is slot-type connecting device set on the tree-shaped shells 27-A & 27-B. Part 23 is the chemiluminescent component. We can make chemiluminescent component (23) a tree-shaped one with a mirrored symmetrical pattern, so as to get an preferable glowing effect for this device. In the implementation of this device, the tree-shaped chemiluminescent component (23) is the one with a mirror symmetrical pattern. For part 23, the root is regarded as the center. When using this device, double over the mirror pattern of chemiluminescent component (23), and clip it between shell 27-A & 27-B. Then, the shell (27-A) is connected with Part 27-B to form the shell (27) via slot-type connecting device (24).

Figure 36:
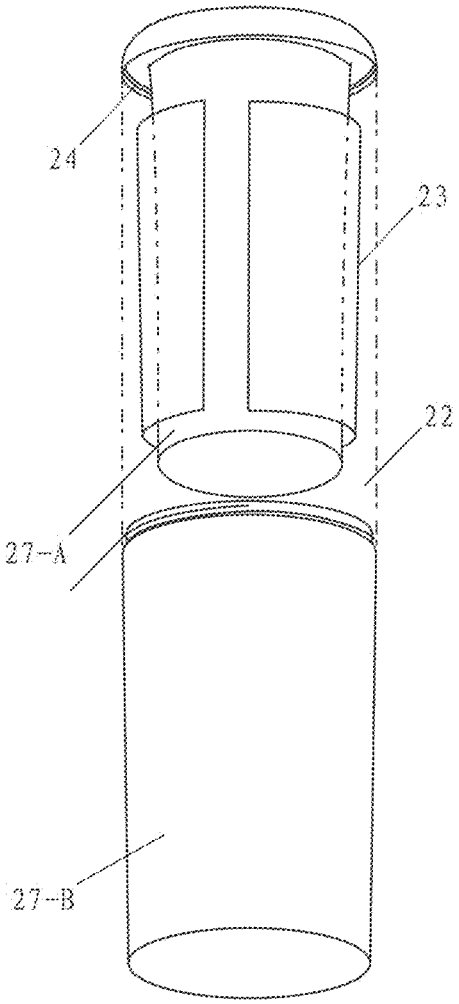
FIG. 36 is a schematic diagram of a cup-shaped chemiluminescent device that provides an encapsulating space within a barrier made from thin film

As illustrated in FIG. 36, the shell (27) is comprised of an inner cup-shaped shell 27-A & outer cup-shaped shell 27-B. The contained space (22) is formed between inner cup-shaped shell 27-A & outer cup-shaped shell 27-B. Part 23 is a chemiluminescent component made from a thin film. In order to make inner cup-shaped shell 27-A & outer cup-shaped shell 27-B assemble firmly together, we could set connecting device (24), such as a buckle or turnbuckle, at the interface of the inner cup-shaped shell 27-A & outer cup-shaped shell 27-B. Also, the inner cup-shaped shell 27-A & outer cup-shaped shell 27-B could be assembled together via the friction existing at the connecting part. When using it, make chemiluminescent component (23) begin glowing, wrap the inner cup-shaped shell 27-A with it, insert them into the outer cup-shaped shell 27-B, and then clamp the connectin device (24), the device is ready to be used.

In the implementation of the device, chemiluminescent component (23) that is made from a thin film can be designed into fan shape. In this design, the inner cup-shaped shell 27-A is able to be wrapped more fit by chemiluminescent component (23), also the whole body of the cup glows well when the cup is used. It is feasible that other geometrical shapes, such as a circle, triangle, etc. or designs of animals or plants are adopted for chemiluminescent component (23) with different colors. Several chemiluminescent components (23) can be put into contained space (22). Thus, when using the device, a different color light could be sent out from different aspects of the cup to show different images. We also can make chemiluminescent component (23) a multi-layer or multi-cavity one with the same or different colors. So when using this device, light with different colors can be seen from chemiluminescent components that are made from thin film. This makes the device more splendid in color.

In practical production, an ordinary cup-shaped shell also could be inserted into another one. And then the chemiluminescent device placed into the space formed by the two cup-shaped shells. When making the shell according to this method, the shapes of the two cup-shaped shells could be different. For example, a quadrate cup-shaped shell could be inserted into a ring-shaped shell or polygonal one. It is certain when making the shell, we should pay attention to that to make sure the shapes of contacting parts of cup-shaped shell & the other shell set outside are the same.

Figure 37:
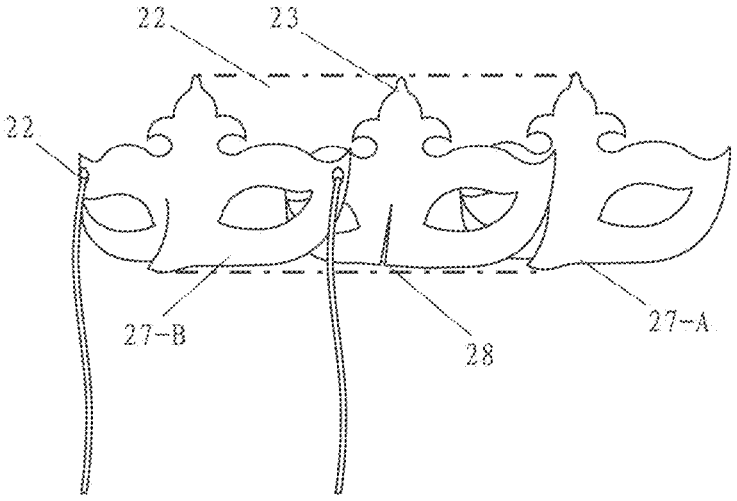
FIG. 37 is a schematic diagram of a mask-shaped chemiluminescent device that provides an encapsulating space within a barrier made from thin film

As illustrated in FIG. 37, part 27 is a mask-shaped shell. It is comprised of the inner mask-shaped shell (27-A) and the outer one (27-B). The two shells stack together to form part 27. The contained space (22) is formed between Part 27-A and Part 27-B. Part 23 is a chemiluminescent component made from thin film, which is placed in the contained space (22). Part 24 is a fixed connecting device set on the outer mask-shaped shell (27-B). In the implementation of the device, the fixed connecting device is the rope set in the outer mask-shaped shell (27-B). When using this device, the user can make chemiluminescent component (23) begin glowing, then clip it between the inner mask-shaped shell (27-A) and the outer one (part 27-B). The device can be tied to a user's head via the rope-type fixed connecting device, which is set on the outer mask-shaped shell (27-B).

At this moment, chemiluminescent component (23) and the inner mask-shaped shell (27-A) will be fixed between the outer mask-shaped shell (27-B) and the user's face via pressure. In actual use, as chemiluminescent component (23) is planar and there must be ups and downs for the mask, according to human facial features. The opening (28) can be set at the position of the nose, where the nose is designed on chemiluminescent component (23). In this way, chemiluminescent component (23) could be better placed between the inner mask-shaped shell (27-A) and the outer one (27-B). In practical production, we also could make this device a whole piece of mask. At this moment, the opening (28) could be set at different positions on chemiluminescent component (23) according to the facial form. Apart from placing the chemiluminescent component (23) at the mask's interlayer, we also could set Part 23 outside the mask. For example, chemiluminescent component (23) could be made of a long red glowing tongue as a pendant in the mouth of the mask, so as to enhance the atmosphere when using this device. In order to facilitate the wearing of this device for the user, the materials with a shape-memory can be inserted into the surface or interior of the inner mask-shaped shell (27-A) and the outer one (27-B). Or the materials could be directly made into mask-shaped shell (27-A) & (27-B). For instance, the materials could be metals or plastic with shape-memory or a composite comprised of metal & plastic. The curvatures of these kinds of materials are big enough, and have super elasticity & high plasticity. The user's head can be wrapped by the mask then.

In the implementation of this device, in order to fix chemiluminescent component (23) firmly in contained space (22) by means of mask-shaped shell (27-A) & (27-B), we also can make use of an incidental fixing device, for instance, a clip, double faced adhesive tape, rope, hook, etc., to auxiliarily fix it. Reflecting materials also could be set on the surface of the contained space (22) in order to increase its brightness.

INDUSTRIAL APPLICATION

This invention provides an all-new chemiluminescent device, in which a thin film is used as the shell. The impermeability of the aluminum foil, composite of macromolecular materials with aluminum foil, or other impermeable macromolecular materials can be adopted to protect the ingredients, which contain oxalate or oxidizer. It has changed the restriction of existing technology from the aspect of the device's structure, and avoids the usage of glass tubes. At the same time, it could increase the amount of chemical liquids loading significantly; also, it could reduce damages during the production, storage and transportation. Some of these technical schemes can also solve the aluminum foil's shading problem to make this device glow from 360 degrees' direction. Furthermore, this invention also provides a solution to improve the image showing capability for chemiluminescent devices. In this way, chromatic or a well-bedded image showing device could be fully shown against the glowing background. Meanwhile, shaped devices that support chemiluminescent devices made from thin film can also be provided, at the same time improving the disadvantages that the device can not be used in vertical direction & hard to keep physical form due to the liquids flow.

The invention claimed is:

1. A chemiluminescent device comprising:

a cavity enclosed by a transparent or translucent thin film, wherein a part of the enclosed cavity that stores luminescent agent is placed within one or more impermeable bags that contain aluminum foil and wherein the luminescent agent contains oxalate, and a division sealing device set at an opening of each impermeable bag such that a part of the enclosed cavity inside the impermeable bag is separated from a part outside of the impermeable bag by the division sealing device, wherein two or more impermeable storage cavities are formed, and wherein the luminescent agent and an oxidizer are sealed in the different storage cavities.

2. The chemiluminescent device of claim 1, wherein the cavity enclosed by the transparent or translucent thin film is placed into an impermeable bag and sealed from an outer environment, and one or more division sealing devices are set outside of the impermeable bag such that the enclosed cavity is separated and sealed into two or more impermeable storage cavities, and wherein the luminescent agent and oxidizer are sealed into the different storage cavities.

3. The chemiluminescent device of claim 1, wherein the cavity is made from a thin film with a continuous shell made from a macromolecular material, wherein part of the thin film is combined with aluminum foil to form the impermeable bag, the luminescent agent being stored in the part with the impermeable bag, and the oxidizer being stored in an area that is not combined with aluminum foil, and wherein a removable division sealing device is set outside the impermeable bag or inside the cavity between the part with the impermeable bag and the area not combined with aluminum foil to separate the luminescent agent and the oxidizer.

4. The chemiluminescent device of claim 1, wherein the cavity is made from a continuous shell made from a macromolecular material including a part that is wrapped by the impermeable bag made with aluminum foil and having an inner surface that is combined with the macromolecular material, wherein a connective sealing structure is set between the inner surface of the impermeable bag and an external surface of the enclosed cavity, the luminescent agent being placed within an area of the enclosed cavity that is wrapped by the impermeable bag, and the oxidizer being placed within an area not wrapped by the impermeable bag, and wherein a removable division sealing device is set outside the impermeable bag or inside the enclosed cavity between the two areas to separate the luminescent agent and the oxidizer.

5. The chemiluminescent device of claim 1, wherein the cavity enclosed by the thin film includes an opening made from a macromolecular material, and the impermeable bag is a cavity with an opening made from aluminum foil, and having an inner surface combined with the macromolecular material, wherein the two cavities are linked together via the opening, and the luminescent agent is placed within an area in the impermeable bag while the oxidizer is placed within an area of the enclosed cavity where there is no impermeable bag, the chemiluminescent device including a removable division sealing device that is set either outside the impermeable bag or inside the enclosed cavity between the two areas to separate the luminescent agent and the oxidizer.

6. A chemiluminescent device comprising:

a cavity enclosed by a transparent or translucent thin film, wherein a luminescent agent and an oxidizer are placed in the cavity within at least one sealed breakable chemical storage bag having one or more layers, and wherein an aluminum foil layer made of one or more layers of aluminum foil is set outside the at least one breakable chemical storage bag.

7. The chemiluminescent device of claim 6, wherein the aluminum foil layer made of one or more layers of aluminum foil is formed by one or more pieces of aluminum foil, and an edge of aluminum foil is exposed and folded one or more times together with other parts that contact the edge.

8. The chemiluminescent device of claim 6, wherein the aluminum foil layer made of one or more layers of aluminum foil and set outside the at least one breakable chemical storage bag is at least partially soaked in a solidifiable liquid sealing material that provides a sealing layer on the aluminum foil, and wherein the part of the aluminum foil layer soaked in the solidifiable liquid sealing material is soaked in the sealing material to seal gaps between folds.

9. The chemiluminescent device of claim 8, wherein the sealing material is one of a solidifiable liquid macromolecule resin, wax, and caking agent, and wherein solidified states are breakable.

10. The chemiluminescent device of claim 6, wherein an outside aluminum foil layer is wrapped by a nonocclusive thin film made from a macromolecule polymer.

11. The chemiluminescent device of claim 7, wherein a color in the enclosed cavity can be identical or different among one or more luminescent agents and one or more oxidizers.

12. The chemiluminescent device of claim 6, wherein the at least one sealed breakable chemical storage bag is one of transparent, translucent and opaque.

13. The chemiluminescent device of claim 6, where the at least one sealed breakable chemical storage bag is wrapped by the layer of aluminum foil.

14. The chemiluminescent device of claim 1, wherein material of the impermeable bag is a composite of a macromolecular material with aluminum foil, and where the macromolecular material is at least one of PET, PP, and PE, and where a thickness of the aluminum foil is 0.003 mm-0.3 mm, specifically between 0.01 mm and 0.2 mm, and where a thickness of the impermeable bag is 0.001 mm-0.5 mm, specifically between 0.03 mm and 0.4 mm.

15. The chemiluminescent device claim 1, wherein an absorbent layer is set in the cavity, and wherein a material of the absorbent layer is chosen from at least one of fabric, non-woven fabric, expanded materials and paper.

16. The chemiluminescent device of claim 6, wherein the chemiluminescent device is formed via multi-layered folding and splicing.

17. The chemiluminescent device of claim 16, further including a shared plastic film of surfaces that contact each other.

18. A chemiluminescent device comprising:

a cavity enclosed by a transparent or translucent thin film, wherein one or more impermeable bags are placed over a part of said enclosed cavity, a division sealing device set at an opening of each impermeable bag such that a part of the enclosed cavity inside the impermeable bag is separated from a part outside of the impermeable bag by the division sealing device, wherein two or more impermeable storage cavities are formed, wherein a luminescent agent and an oxidizer are sealed in the different storage cavities, and wherein the luminescent agent and oxidizer are respectively sealed in breakable chemical storage bags with one or more layers, the breakable chemical storage bags being one of transparent, translucent and opaque.

19. The chemiluminescent device of claim 18, wherein the chemiluminescent device is formed via multi-layered folding and splicing.

* * * * *